US006028398A

United States Patent [19]

Kawasaki et al.

[11] Patent Number: 6,028,398

[45] Date of Patent: Feb. 22, 2000

[54] COLD CATHODE FLUORESCENT LAMP DRIVING APPARATUS USING A PIEZOELECTRIC TRANSFORMER

[75] Inventors: Osamu Kawasaki, Tsuzuki-gun; Hiroshi Iwata, Nabari; Kazuou Murata, Settsu; Hiroshi Makino, Hirakata; Wataru Hasegawa, Sakai, all of Japan

[73] Assignees: Matsushita Electric Industrial, Co., Ltd.; West Electric Company, Ltd., both of Osaka, Japan

[21] Appl. No.: 08/698,049

[22] Filed: Aug. 15, 1996

[30] Foreign Application Priority Data

Aug. 16, 1995 [JP] Japan ..... 7-208636

[51] Int. Cl.[7] ..... H05B 37/02

[52] U.S. Cl. ..... 315/224; 315/276; 315/307; 315/DIG. 5; 315/DIG. 7

[58] Field of Search ..... 315/224, 307, 315/DIG. 5, DIG. 7, 276; 363/133

[56] References Cited

U.S. PATENT DOCUMENTS 5,548,189 8/1996 Williams ..... 315/224

FOREIGN PATENT DOCUMENTS 0 665 600 A1 8/1995 European Pat. Off. .
08033352 2/1996 Japan .
08047265 2/1996 Japan .

*Primary Examiner*—Michael B Shingleton
*Attorney, Agent, or Firm*—Ratner & Prestia

[57] ABSTRACT

An AC driving signal of a frequency in the vicinity of the resonance frequency of a piezoelectric transformer is generated by a variable oscillation circuit and the waveform of the output signal of the variable oscillation circuit is shaped so as to be substantially sinusoidal by a waveform shaping circuit and the output of the waveform shaping circuit is subjected by a driving circuit to current amplification or voltage amplification so as to be amplified to a level sufficient for driving the piezoelectric transformer and the output of the driving circuit is subjected to current limitation, and then input to the piezoelectric transformer and the output signal of the transformer is applied to a cold cathode fluorescent lamp so that the cold cathode fluorescent lamp is lit and even if the impedance of the cold cathode fluorescent lamp decreases, the piezoelectric transformer cannot supply a large current.

20 Claims, 15 Drawing Sheets

COLD CATHODE FLUORESCENT LAMP DRIVING APPARATUS USING A PIEZOELECTRIC TRANSFORMER

BACKGROUND OF THE INVENTION

1. Field of the Invention

The invention relates a cold cathode fluorescent lamp driving apparatus using a piezoelectric transformer which transforms the amplitude of an AC voltage by the piezoelectric effect of a piezoelectric element such as a piezoelectric ceramics.

2. Related Art of the Invention

A piezoelectric transformer developed at the end of the nineteen fifties was further developed because it received attention as a step-up transformer for a high voltage power source. However, material restrictions such as a breaking strength of a piezoelectric ceramic material prevented a piezoelectric transformer from being greatly commercially introduced, and its development was suspended. In recent years, development of a high-strength piezoelectric ceramic progresses, and portable information devices such as note-type personal computers, electronic organizers, and game machines are significantly required to be smaller and thinner. With such development and requirements, great attention is again directed toward a piezoelectric transformer as a step-up transformer in an inverter power source for a liquid crystal back light which is mounted on such a device.

An inverter for a back light is used as a power source for a cold cathode fluorescent lamp which is used as a source for a back light. The inverter requires transformation of a low DC voltage such as 5 V, 9 V, or 12 V supplied from a battery to a high-frequency voltage of a high voltage of about 1,000 Vrms at a start of the lighting and of about 500 Vrms in a steady state. An electromagnetic wound-type transformer which is currently used in an inverter for a back light utilizes a horizontal structure having a special core so as to comply with a tendency to a thinner body. In order to ensure a withstand voltage, however, there is a limit for realizing a smaller and thinner transformer. In addition, because the core loss is large and the use of a thin copper wire causes the winding loss to be increased, the efficiency is disadvantageously low.

On the other hand, a piezoelectric transformer has the following configuration. Primary (input side) and secondary (output side) electrodes are disposed on a piezoelectric ceramic material such as lead zirconate titanate (PZT) or a piezoelectric crystal material such as lithium niobate. An AC voltage of a frequency which is in the vicinity of the resonance frequency of the piezoelectric transformer is applied to the primary side so that the piezoelectric transformer is caused to mechanically resonate. The mechanical oscillation is transformed by the piezoelectric effect so as to be taken out from the electrode on the secondary side in the form of a high-voltage power. Such a piezoelectric transformer can realize a smaller body, and especially a thinner body as compared with an electromagnetic transformer. In addition, the piezoelectric transformer can attain a high conversion efficiency.

Hereinafter, a prior art cold cathode fluorescent lamp driving apparatus using a piezoelectric transformer will be described with reference to the relevant drawings.

FIG. 20 is a view schematically showing a Rosen-type piezoelectric transformer. The piezoelectric transformer is constructed in such a manner that electrodes on the primary side (input side) and the secondary side (output side) are disposed on a rectangular plate made of a piezoelectric ceramic material such as lead zirconate titanate (PZT). As indicated by P in the figure, the primary side is polarized in the thickness direction of the rectangular plate, and the secondary side is polarized in the longitudinal direction. When an AC voltage of a frequency in the vicinity of the resonance frequency of the piezoelectric transformer is applied to the primary electrodes, the piezoelectric transformer is caused to mechanically oscillate in the longitudinal direction. The mechanical oscillation is transformed into a voltage by the piezoelectric effect, so as to be taken out as a high-voltage power from the secondary electrodes.

FIG. 21 is a block diagram of a prior art driving circuit for the piezoelectric transformer shown in FIG. 20, i.e., a prior art cold cathode fluorescent lamp driving apparatus using a piezoelectric transformer. Conventional systems for driving a piezoelectric transformer include a self-excited oscillation circuit system and a separately excited oscillation circuit system. The self-excited oscillation circuit system has a problem in conversion efficiency, and contains drawbacks such as that the system cannot follow a large fluctuation of loads. Because of these reasons,in recent prior art examples, the separately excited oscillation circuit system is often used. The driving circuit shown in FIG. 21 is also a driving circuit of the separately excited system.

In FIG. 21, a variable oscillation circuit 101 generates an AC driving signal of a frequency in the vicinity of the resonance frequency of a piezoelectric transformer 104. The output signal of the variable oscillation circuit 101 is waveform-shaped into a substantially sinusoidal wave by a waveform shaping circuit 102 in order to reduce a loss in the piezoelectric transformer 104. As the waveform shaping circuit 102, a low pass filter is used in a simple case, and a bandpass filter is used in the case where the efficiency is significant. The output of the waveform shaping circuit 102 is subjected to current amplification or voltage amplification so as to have a level at which a driving circuit 103 can sufficiently drive the piezoelectric transformer. The driving circuit 103 is configured by only a usual amplifying circuit consisting of transistors, or by a combination of an amplifying circuit and a step-up transformer. The output of the driving circuit 103 is boosted by the piezoelectric transformer 104, and then applied to a cold cathode fluorescent lamp 105 so that the cold cathode fluorescent lamp 105 is lit.

The resonance frequency of the piezoelectric transformer 104 is varied because of changes in environments such as the temperature and the load. If a piezoelectric transformer is driven by a constant frequency as in the circuit shown in FIG. 21, therefore, the relationship between the piezoelectric transformer and the driving frequency is varied. When the driving frequency is largely deviated from the resonance frequency of the piezoelectric transformer, the voltage stepup ratio of the piezoelectric transformer is significantly reduced so that a sufficient current cannot be caused to flow through the cold cathode fluorescent lamp 105. Thus, the cold cathode fluorescent lamp 105 cannot keep sufficient brightness.

A circuit shown in FIG. 22 can comply with the variation in the resonance frequency of the piezoelectric transformer 104. FIG. 22 is a block diagram of another prior art driving circuit of the piezoelectric transformer 104 shown in FIG. 20, i.e., a prior art cold cathode fluorescent lamp driving apparatus using a piezoelectric transformer. Functions of a variable oscillation circuit 101, a waveform shaping circuit 102, a driving circuit 103, and a piezoelectric transformer 104 are the same as those in the circuit shown in FIG. 22. In the circuit shown in FIG. 22, a feedback resistor 106 having a small resistance is connected in series to the cold cathode fluorescent lamp 105 so that the current flowing through the cold cathode fluorescent lamp 105 is detected via the feedback resistor 106. The voltage across the feedback resistor 106 is input to an oscillation control circuit 107. The oscillation control circuit 107 controls the frequency of the output signal of the variable oscillation circuit 101 in such a manner that the voltage across the feedback resistor 106 is constant, i.e., the current flowing through the cold cathode fluorescent lamp 105 is constant. As a result of the control, the cold cathode fluorescent lamp 105 is lit with substantially constant brightness. At this time, the driving frequency is kept having a substantially constant relationship with the resonance frequency of the piezoelectric transformer.

In the above, the driving circuit of the separately excited oscillation circuit system has been described as a prior art example of the piezoelectric transformer driving apparatus.

If a cold cathode fluorescent lamp is driven by an AC voltage, however, the characteristics are greatly and drastically changed, that is, the absolute value and the phase of the impedance change greatly and drastically. In the case where the cold cathode fluorescent lamp is driven by an AC voltage of a high frequency, particularly, the changes are considerably large and complicated. In addition, if the tube diameter is reduced, the tendency greatly appears. In the above-described prior art piezoelectric transformer driving apparatuses, the above-mentioned changes of the cold cathode fluorescent lamp are not considered. Thus, the prior art driving apparatuses cannot comply with the changes, and the current flowing through the cold cathode fluorescent lamp is pulsated so that brightness cannot be kept constant. As a result, there exist problems in that the reliability of the cold cathode fluorescent lamp is reduced, and that the life period of the lamp is shortened.

If the current flowing through the cold cathode fluorescent lamp is pulsated, even the driving apparatus shown in FIG. 19 cannot control the current flowing through the cold cathode fluorescent lamp so as to be constant. Thus, the driving frequency cannot be kept having a substantially constant relationship with the resonance frequency of the piezoelectric transformer, so that the driving efficiency of the piezoelectric transformer is reduced and also the efficiency of the cold cathode fluorescent lamp driving apparatus using the piezoelectric transformer is reduced. In addition, the piezoelectric transformer is greatly disturbed by the pulsation so that heat generation is increased. As a result, there exists a problem in that the reliability is significantly degraded.

SUMMARY OF THE INVENTION

It is an object of the invention to provide a cold cathode fluorescent lamp driving apparatus using a piezoelectric transformer in which a pulsation of a current flowing through a cold cathode fluorescent lamp is suppressed so that brightness of the cold cathode fluorescent lamp is constant and the controllability of the current flowing through the cold cathode fluorescent lamp is enhanced. It is another object of the invention to provide a cold cathode fluorescent lamp driving apparatus using a piezoelectric transformer in which the driving efficiencies and reliabilities of a cold cathode fluorescent lamp and the piezoelectric transformer are enhanced and their life periods are prolonged, thereby satisfying all the conditions of high driving efficiency, high reliability, and a long life period.

A first embodiment of the invention utilizes a cold cathode fluorescent lamp driving apparatus using a piezoelectric transformer, comprising: an oscillation circuit which generates an alternating-current driving signal; a driving circuit which amplifies the alternating-current driving signal; a piezoelectric transformer in which an input electrode and an output electrode are disposed on a piezoelectric element; and a cold cathode fluorescent lamp, wherein a resistor for limiting a current is connected in series between an output of the amplifying circuit and the input electrode of the piezoelectric transformer.

A second embodiment of the invention utilizes a cold cathode fluorescent lamp driving apparatus using a piezoelectric transformer, comprising: an oscillation circuit which generates an alternating-current driving signal; a driving circuit which amplifies the alternating-current driving signal; a piezoelectric transformer in which an input electrode and an output electrode are disposed on a piezoelectric element; and a cold cathode fluorescent lamp, wherein a resistor for limiting a current is connected in series between the output electrode of the piezoelectric transformer and the cold cathode fluorescent lamp.

A third embodiment of the invention utilizes a cold cathode fluorescent lamp driving apparatus using a piezoelectric transformer, comprising: an oscillation circuit which generates an alternating-current driving signal; a driving circuit which amplifies the alternating-current driving signal; a piezoelectric transformer in which an input electrode and an output electrode are disposed on a piezoelectric element; and a cold cathode fluorescent lamp, wherein the driving circuit comprises a current amplifying circuit and a step-up transformer, and an output impedance of the step-up transformer is about 5% to 20% of an input impedance of the piezoelectric transformer.

A fourth embodiment of the invention utilizes a cold cathode fluorescent lamp driving apparatus using a piezoelectric transformer, comprising: an oscillation circuit which generates an alternating-current driving signal; a driving circuit which amplifies the alternating-current driving signal; a piezoelectric transformer in which an input electrode and an output electrode are disposed on a piezoelectric element; and a cold cathode fluorescent lamp, wherein a capacitor for balancing loads is connected in series to a ground side of the cold cathode fluorescent lamp.

A fifth embodiment of the invention utilizes a cold cathode fluorescent lamp driving apparatus using a piezoelectric transformer, comprising: an oscillation circuit which generates an alternating-current driving signal; a driving circuit which amplifies the alternating-current driving signal; a piezoelectric transformer in which an input electrode and an output electrode are disposed on a piezoelectric element; and a cold cathode fluorescent lamp, wherein the piezoelectric transformer has balanced outputs, and the cold cathode fluorescent lamp is connected to the balanced outputs.

According to the first aspect of the invention, in order to suppress the characteristic fluctuation of a cold cathode fluorescent lamp, a resistor having a value in the range of, for example, several percent to several tens of percent of the input impedance of a piezoelectric transformer is connected between a driving circuit and an input terminal of the piezoelectric transformer. Because of the connection of the resistor, even if the impedance of the cold cathode fluorescent lamp decreases, the piezoelectric transformer cannot supply a large current. Thus, the value of a current flowing through the cold cathode fluorescent lamp can be kept substantially constant so that the pulsation is suppressed.

According to the second aspect of the invention, in order to suppress the characteristic fluctuation of a cold cathode fluorescent lamp, a resistor having a value in the range of, for example, several percent to several tens of percent of the input impedance of the cold cathode fluorescent lamp is connected between an input terminal of a piezoelectric transformer 5 and the cold cathode fluorescent lamp 6. Because of the connection of the resistor, even if the impedance of the cold cathode fluorescent lamp decreases, the piezoelectric transformer cannot supply a large current. Thus, the value of a current flowing through the cold cathode fluorescent lamp cannot be kept substantially constant so that the pulsation is suppressed.

According to the third aspect of the invention, an electromagnetic step-up transformer is connected between a driving circuit and an input terminal of a piezoelectric transformer, and the output impedance of the step-up transformer 14 is set to be high or in the range of several percent to several tens of percent of the input impedance of the piezoelectric transformer 5. Even if the impedance of the cold cathode fluorescent lamp decreases, therefore, the piezoelectric transformer cannot supply a large current. As a result, the value of a current flowing through the cold cathode fluorescent lamp can be kept substantially constant so that the pulsation is suppressed.

According to the fourth aspect of the invention, a capacitor is connected in series between a cold cathode fluorescent lamp and the common level. Therefore, the cold cathode fluorescent lamp is driven in such a condition that their terminals are connected to an output capacitance of a piezoelectric transformer and a capacitance of the capacitor, respectively. Thus, a pulsation of a current of the cold cathode fluorescent lamp can be suppressed, and the value of the current flowing through the cold cathode fluorescent lamp can be kept substantially constant.

According to the fifth aspect of the invention, a piezoelectric transformer having balanced outputs is used so that the characteristic fluctuation of a cold cathode fluorescent lamp is suppressed. Thus, the value of a current flowing through the cold cathode fluorescent lamp can be kept substantially constant and the pulsation can be suppressed, thereby providing a cold cathode fluorescent lamp driving apparatus using a piezoelectric transformer which stably operates.

LEGEND OF THE REFERENCE NUMERALS

Figure 1:
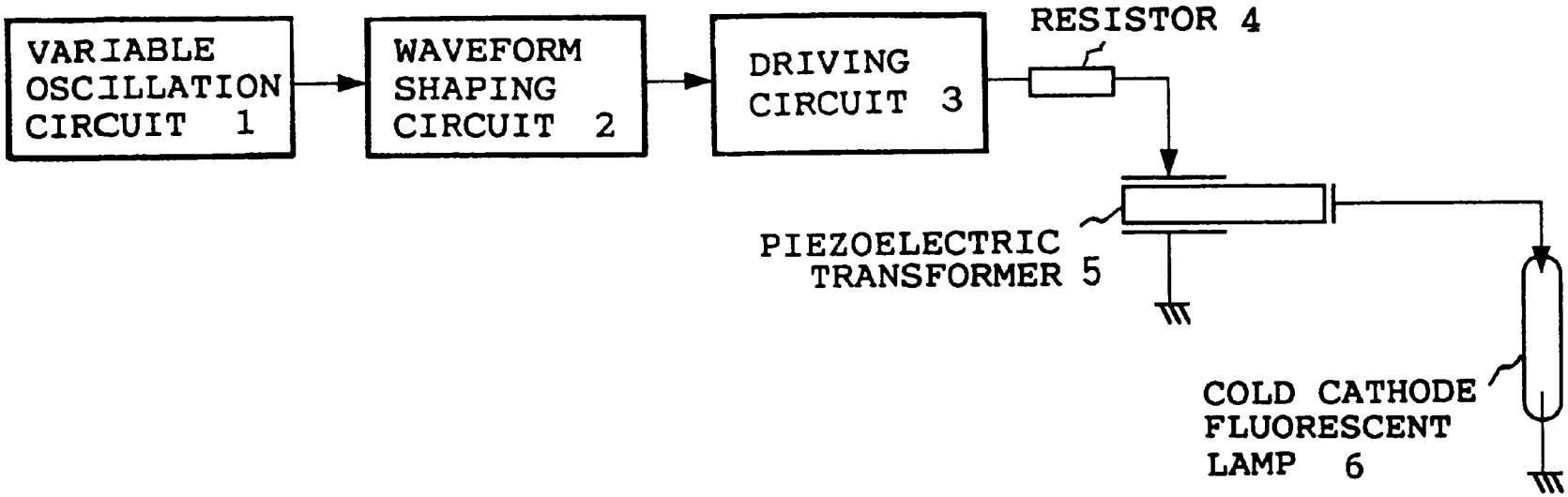
FIG. 1 is a block diagram of an example of Embodiment 1 of the cold cathode fluorescent lamp driving apparatus using a piezoelectric transformer according to the invention.

1 variable oscillation circuit
2 waveform shaping circuit

3 driving circuit
4 resistor
5 piezoelectric transformer
6 cold cathode fluorescent lamp
7 feedback resistor
8 oscillation control circuit
9 resistor
10 feedback resistor
11 dividing resistor
12 dividing resistor
13 current amplifying circuit
14 electromagnetic step-up transformer
15 resistor
16 capacitor
17 capacitor
18 piezoelectric transformer
19 piezoelectric transformer
20 piezoelectric transformer
21 piezoelectric transformer
22 piezoelectric transformer
23 piezoelectric transformer

PREFERRED EMBODIMENTS

Hereinafter, embodiments of the invention will be described in detail with reference to the drawings.

Embodiment 1

FIG. 1 is a block diagram showing a cold cathode fluorescent lamp driving apparatus using a piezoelectric transformer, i.e., an inverter circuit. In the figure, the piezoelectric transformer 5 may be a piezoelectric transformer of any desired type, i.e., a Rosen type or another type. A variable oscillation circuit 1 generates an AC driving signal of a frequency in the vicinity of the resonance frequency of the piezoelectric transformer 5. When the piezoelectric transformer 5 is driven by a driving signal having a rectangular waveform, components other than those in the vicinity of the resonance frequency are transformed into heat in the piezoelectric transformer 5. In the view point of the reliability of the piezoelectric transformer 5 and the conversion efficiency, the waveform of the output signal of the variable oscillation circuit 1 is shaped so as to be substantially sinusoidal by a waveform shaping circuit 2. In a simple case, the waveform shaping circuit 2 is a low pass filter. In the case where the efficiency is especially significant, a band-pass filter is used as the waveform shaping circuit 2. The output of the waveform shaping circuit 2 is subjected by a driving circuit 3 to current amplification or voltage amplification so as to be amplified to a level sufficient for driving the piezoelectric transformer 5. The driving circuit 3 is configured by only a usual amplifying circuit consisting of transistors, or by a combination of an amplifying circuit and a step-up transformer. The output of the driving circuit 3 is input to the piezoelectric transformer 5 via a resistor 4. The piezoelectric transformer 5 boosts the input voltage by the piezoelectric effect. The output signal which is a high voltage of the piezoelectric transformer 5 is applied to a cold cathode fluorescent lamp 6 so that the cold cathode fluorescent lamp 6 is lit.

Figure 2:
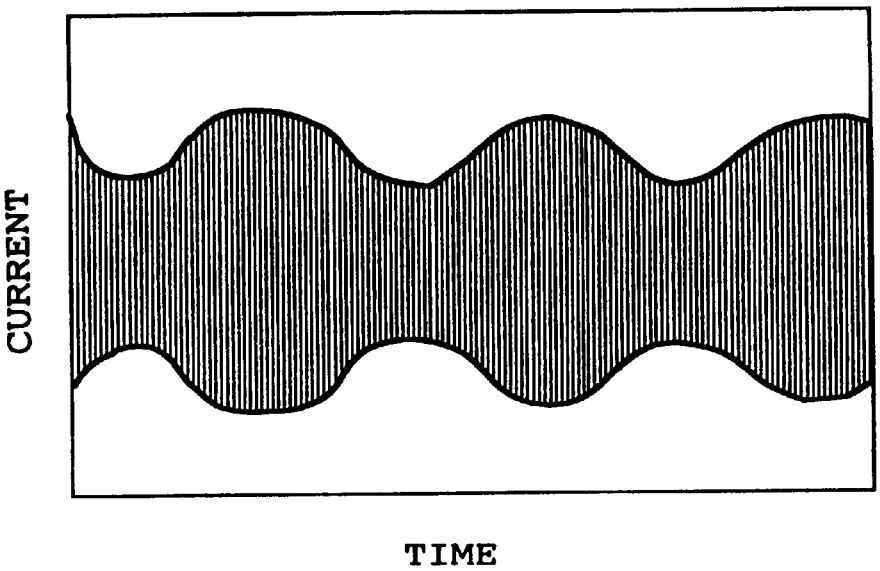
FIG. 2 is a graph showing an envelope waveform of a current of a cold cathode fluorescent lamp in the cold cathode fluorescent lamp driving apparatus using the piezoelectric transformer.

In a cold cathode fluorescent lamp driving circuit using the piezoelectric transformer 5 such as that shown in FIG. 1, usually, the driving frequency is often set to be about 50 to 200 kHz. If such a high frequency is used to drive the cold cathode fluorescent lamp 6, the cold cathode fluorescent lamp 6 exhibits complicated behavior. That is, the absolute value and the phase of the impedance are unstably varied. Even if an AC voltage having a constant amplitude is used for driving, the current flowing through the cold cathode fluorescent lamp 6 is unstably varied (i.e., pulsated) as shown in FIG. 2. In FIG. 2, the abscissa indicates the time, and the ordinate indicates the value of the current flowing through the cold cathode fluorescent lamp 6. In order to clearly show the pulsation, an envelope of the current waveform is shown. The period of the current variation is about several hundreds of Hz to several kHz. The magnitude of the variation reaches several percent to several tens of percent. As the driving frequency is made higher, or as the diameter of the fluorescent lamp is decreased, the unstableness tends to be increased. If the unstableness of the cold cathode fluorescent lamp 6 is increased, the piezoelectric transformer 5 cannot withstand the load fluctuation. Thus, larger operation unstableness is caused in the circuit, and then the heat generation of the piezoelectric transformer 5 is increased so that the characteristics are deteriorated and the life period is shortened. The brightness of the cold cathode fluorescent lamp 6 becomes unstable, and the life period is similarly shortened.

Figure 3:
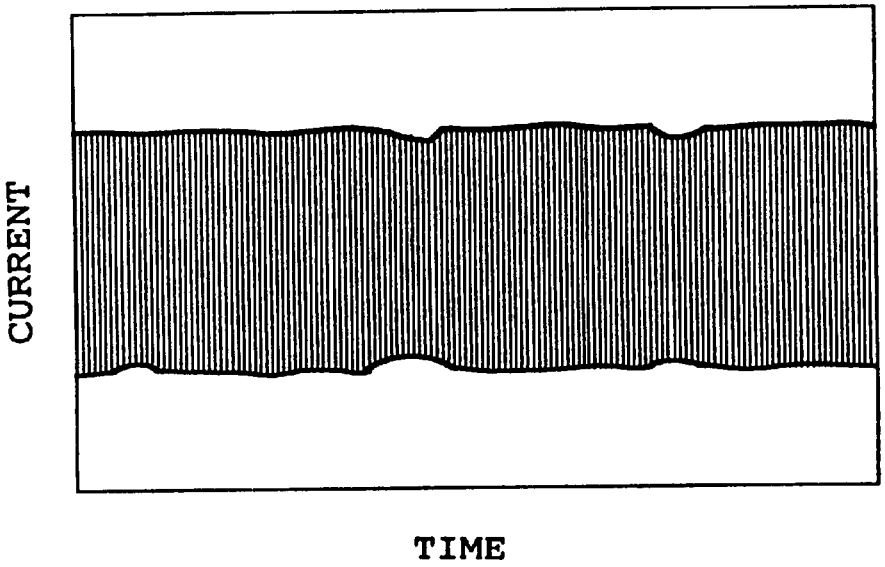
FIG. 3 is a graph showing an envelope waveform of a current of a cold cathode fluorescent lamp in the cold cathode fluorescent lamp driving apparatus using the piezoelectric transformer of the invention.

In the cold cathode fluorescent lamp driving apparatus using a piezoelectric transformer shown in FIG. 1, the resistor 4 is connected between the driving circuit 3 and the input terminal of the piezoelectric transformer 5. Even if the impedance of the cold cathode fluorescent lamp 6 decreases, the piezoelectric transformer 5 cannot supply a large current because of the connection of the resistor 4 for limiting a current. As a result, the value of the current flowing through the cold cathode fluorescent lamp 6 can be kept substantially constant as shown in FIG. 3. In FIG. 3, the abscissa indicates the time, and the ordinate indicates the value of the current flowing through the cold cathode fluorescent lamp 6. Since the input current of the piezoelectric transformer is limited, the output current of the piezoelectric transformer is also limited, and the pulsation of the current flowing through the cold cathode fluorescent lamp 6 such as that shown in FIG. 2 can be suppressed. As the resistance of the resistor 4 is made higher, the effect for suppressing the pulsation of the current increases, but the loss due to the resistor 4 is increased so that the efficiency of the driving circuit is decreased. Thus, the value of the resistor must be appropriately determined in consideration of the magnitude of the pulsation and the driving efficiency. For example, a range of several percent to several tens of percent of the input impedance of the piezoelectric transformer 5 is used as a guide. In an example case where the resistance is about 5% to 20%, it is possible to satisfy the requirements for the efficiency and the stability.

Figure 4:
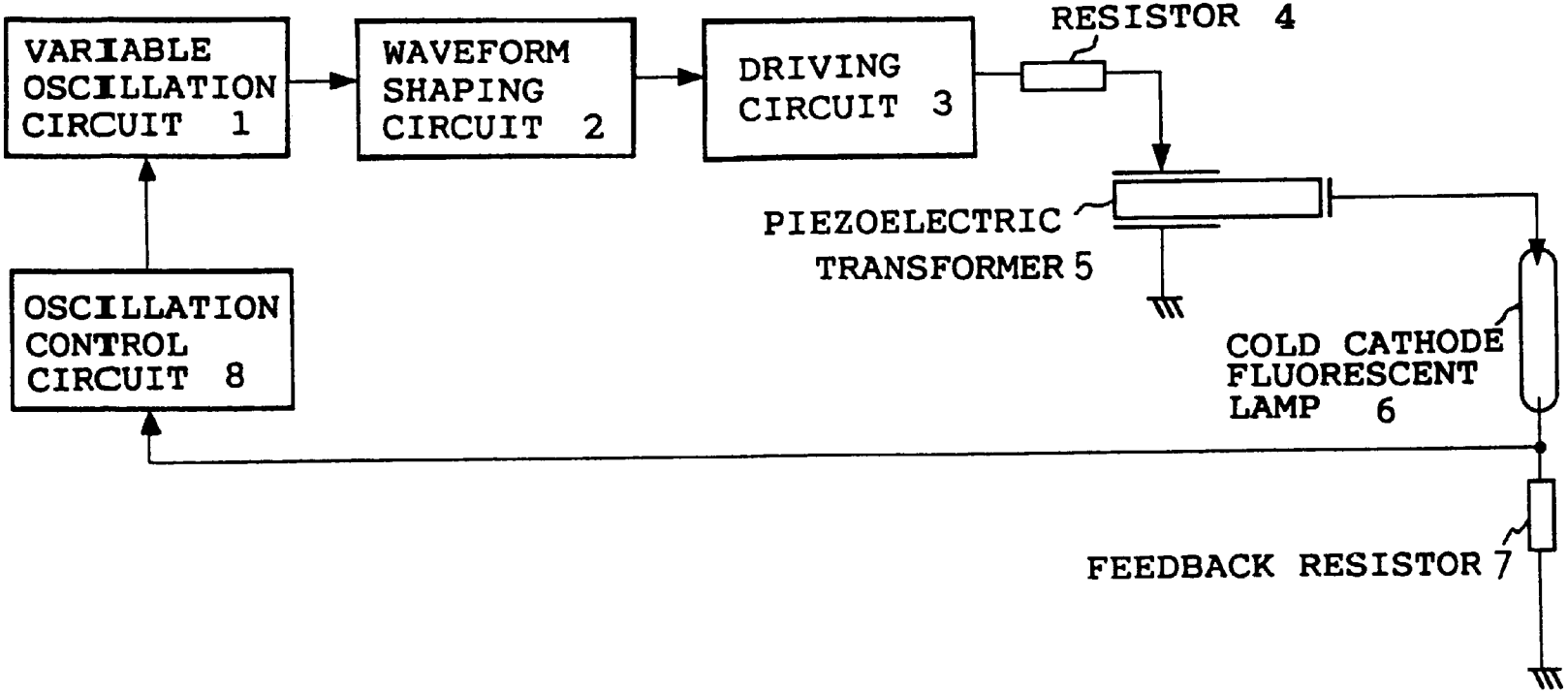
FIG. 4 is a block diagram of another example of Embodiment 1 of the cold cathode fluorescent lamp driving apparatus using a piezoelectric transformer according to the invention.

FIG. 4 is a block diagram of another example of the cold cathode fluorescent lamp driving apparatus using a piezoelectric transformer, i.e., an inverter circuit. In the figure, a variable oscillation circuit 1, a waveform shaping circuit 2, a driving circuit 3, a resistor 4, a piezoelectric transformer 5, and a cold cathode fluorescent lamp 6 have the same functions as those in the example shown in FIG. 1. The resonance frequency of the piezoelectric transformer is varied by changes in environments such as the temperature and the load. If the piezoelectric transformer 5 is driven by a constant frequency as in the circuit shown in FIG. 1, the relationship between the resonance frequency of the piezoelectric transformer 5 and the driving frequency is varied. If the driving frequency is largely deviated from the resonance frequency of the piezoelectric transformer, the voltage stepup ratio of the piezoelectric transformer is critically reduced. As a result, a sufficient current cannot be caused to flow through the cold cathode fluorescent lamp 6, and the cold cathode fluorescent lamp 6 cannot keep sufficient brightness.

The circuit shown in FIG. 4 can comply with the variation in the resonance frequency of the piezoelectric transformer 5 which is due to the environments. A feedback resistor 7 having a small resistance is connected in series to the cold cathode fluorescent lamp 6. The feedback resistor 7 is used for detecting the current flowing through the cold cathode fluorescent lamp 6. The voltage across the feedback resistor 7 is input to an oscillation control circuit 8. The oscillation control circuit 8 controls the frequency of the output signal of the variable oscillation circuit 1 so that the voltage across the feedback resistor 7 is constant, i.e., the current flowing through the cold cathode fluorescent lamp 6 is constant. As a result of the control, the cold cathode fluorescent lamp 6 is lit with substantially constant brightness. At this time, if the resistor 4 is not connected, the impedance of the cold cathode fluorescent lamp 6 changes, and the current flowing through the cold cathode fluorescent lamp 6 is unstably varied as shown in FIG. 2, with the result that it is impossible to control the frequency of the output signal of the variable oscillation circuit 1 so that the current flowing through the cold cathode fluorescent lamp 6 is constant. In other words, the pulsation of the value of the current flowing through the cold cathode fluorescent lamp 6 can be suppressed by the connection of the resistor 4 between the driving circuit 3 and the input terminal of the piezoelectric transformer 5. Thus, it is possible to control the frequency of the output signal of the variable oscillation circuit 1 so that the current flowing through the cold cathode fluorescent lamp 6 is constant.

Embodiment 2

Figure 5:
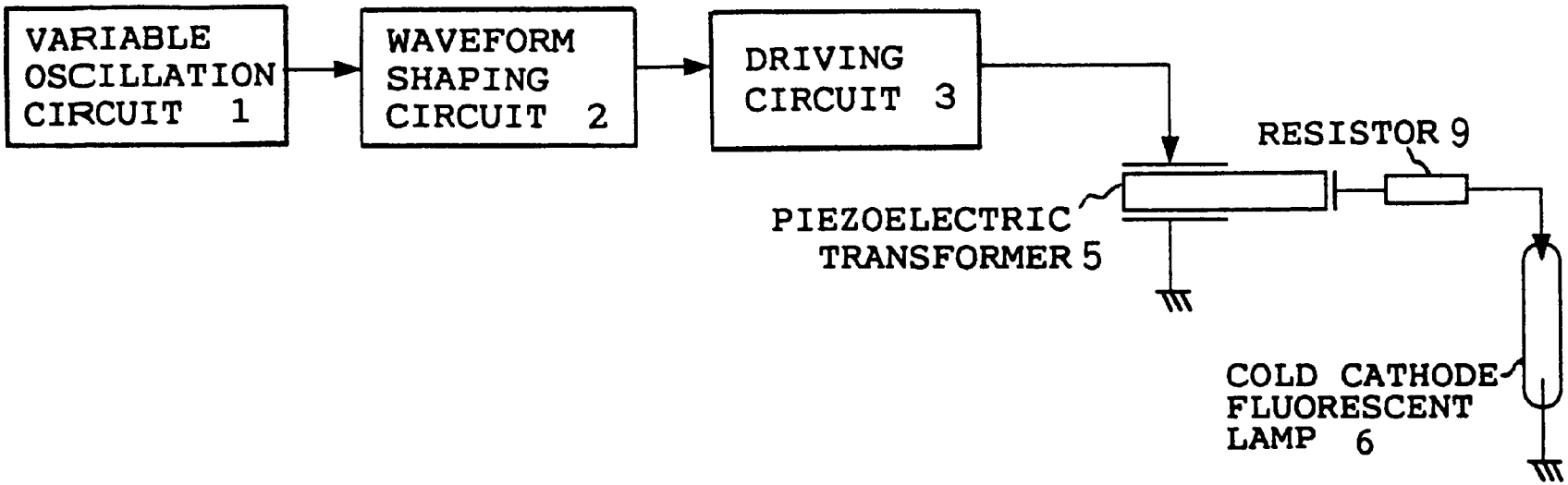
FIG. 5 is a block diagram of an example of Embodiment 2 of the cold cathode fluorescent lamp driving apparatus using a piezoelectric transformer according to the invention.

FIG. 5 is a block diagram showing a cold cathode fluorescent lamp driving apparatus using a piezoelectric transformer, i.e., an inverter circuit of Embodiment 2 of the invention. In the figure, a piezoelectric transformer 5 may be a piezoelectric transformer of any desired type, i.e., a Rosen type or another type. A variable oscillation circuit 1 performs a frequency regulation so as to generate an AC driving signal of a frequency in the vicinity of the resonance frequency of the piezoelectric transformer 5. When the piezoelectric transformer 5 is driven by a driving signal having a pulse waveform, components other than those in the vicinity of the resonance frequency are transformed into heat in the piezoelectric transformer 5 without contributing to the voltage transformation. In the view point of the reliability of the piezoelectric transformer 5 and the conversion efficiency, the waveform of the output signal of the variable oscillation circuit 1 is shaped so as to be substantially sinusoidal by a waveform shaping circuit 2. In a simple case, the waveform shaping circuit 2 is a low pass filter. In the case where the efficiency is especially significant, a bandpass filter is used as the waveform shaping circuit 2. The output of the waveform shaping circuit 2 is subjected by a driving circuit 3 to current amplification or voltage amplification so as to be amplified to a level sufficient for driving the piezoelectric transformer 5. The driving circuit 3 is configured by only a usual amplifying circuit consisting of transistors, or by a combination of an amplifying circuit and a step-up transformer. The output of the driving circuit 3 is input to a driving electrode (an input electrode) of the piezoelectric transformer 5. The piezoelectric transformer 5 boosts the input voltage by the piezoelectric effect. The output signal of the piezoelectric transformer 5 is applied to a cold cathode fluorescent lamp 6 via a resistor 9. The cold cathode fluorescent lamp 6 is stably lit by the function of the resistor 9.

In an inverter circuit using the piezoelectric transformer 5 such as that shown in FIG. 5, usually, the driving frequency of the inverter circuit is often set to be about 50 to 200 kHz because of the easy production of the piezoelectric transformer 5. If such a high frequency is used to drive the cold cathode fluorescent lamp 6, the cold cathode fluorescent lamp 6 exhibits complicated behavior. For example, the absolute value and the phase of the impedance are unstably varied. Even if an AC voltage having a constant amplitude is used for driving, the current flowing through the cold cathode fluorescent lamp 6 is unstably varied (i.e., pulsated) as shown in FIG. 2. In the graph of FIG. 2, the abscissa indicates the time, and the ordinate indicates an envelope of the waveform of the current flowing through the cold cathode fluorescent lamp 6. The period of the current variation is about several hundreds of Hz to several kHz. The magnitude of the variation reaches several percent to several tens of percent. As the driving frequency is made higher, or as the tube diameter of the fluorescent lamp is decreased, the unstableness tends to be increased. If the unstableness of the cold cathode fluorescent lamp 6 is increased, the piezoelectric transformer 5 cannot withstand the load fluctuation. Thus, larger operation unstableness is caused, and then the heat generation of the piezoelectric transformer 5 is increased so that the characteristics are deteriorated and the life period is shortened. The brightness of the cold cathode fluorescent lamp 6 becomes unstable, and the life period is similarly shortened.

In the driving circuit shown in FIG. 5, the resistor 9 is connected between the output terminal of the piezoelectric transformer 5 and the cold cathode fluorescent lamp 6. Even if the impedance of the cold cathode fluorescent lamp 6 decreases, the piezoelectric transformer 5 cannot supply a large current because of the connection of the resistor 9. As a result, the value of the current flowing through the cold cathode fluorescent lamp 6 can be kept substantially constant as shown in FIG. 3. In FIG. 3, the abscissa indicates the time, and the ordinate indicates an envelope of the waveform of the current flowing through the cold cathode fluorescent lamp 6. Since the output current of the piezoelectric transformer is limited, the pulsation of the current flowing through the cold cathode fluorescent lamp 6 such as that shown in FIG. 2 can be suppressed. As the resistance of the resistor 9 is made higher, the effect for suppressing the pulsation of the current increases, but the loss due to the resistor 9 is increased so that the efficiency of the driving circuit is decreased. Thus, the value of the resistor must be appropriately determined in consideration of the magnitude of the pulsation and the driving efficiency. For example, a range of several percent to several tens of percent of the input impedance of the cold cathode fluorescent lamp 6 in the driven state is used as a guide. In an example case where the resistance is about 5% to 20%, it is possible to satisfy the requirements for the efficiency and the stability.

Figure 6:
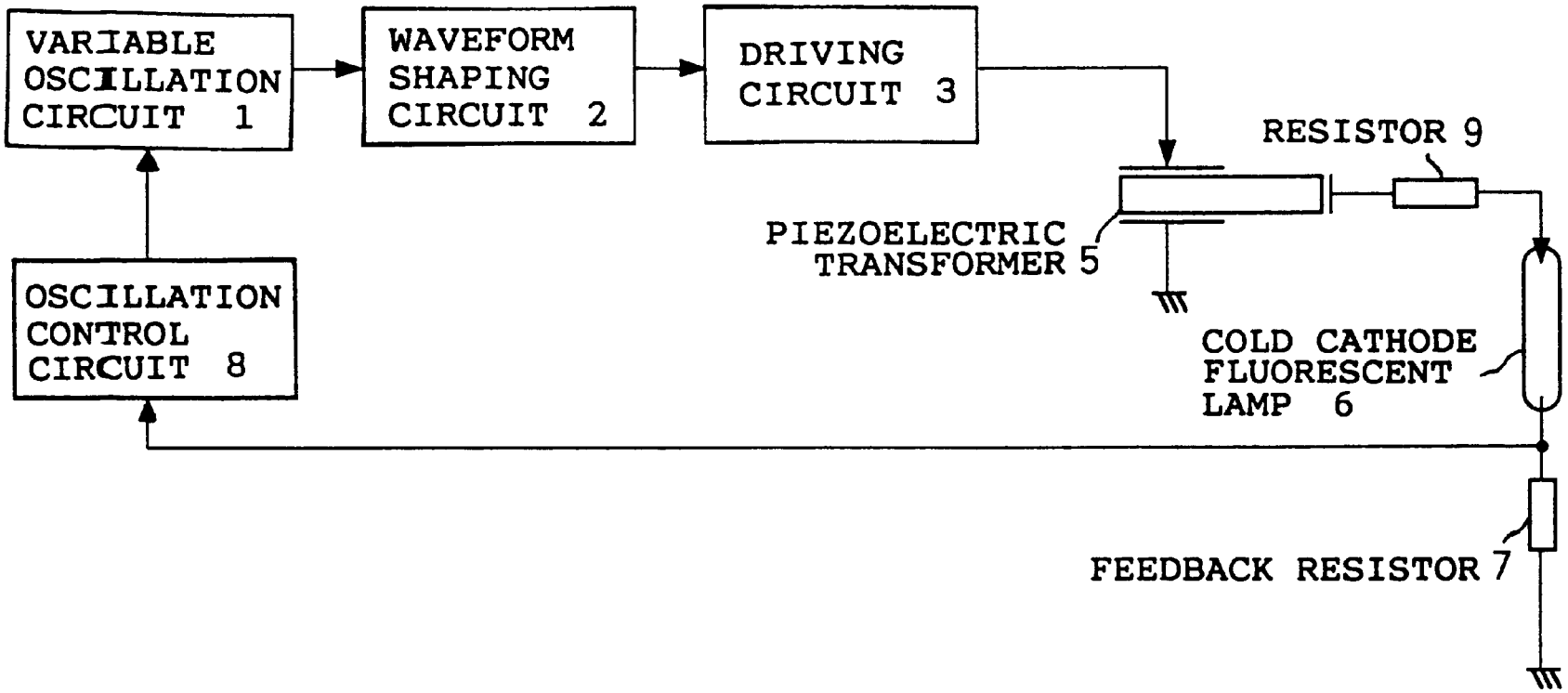
FIG. 6 is a block diagram of another example of Embodiment 2 of the cold cathode fluorescent lamp driving apparatus using a piezoelectric transformer according to the invention.

FIG. 6 is a block diagram of another example of a cold cathode fluorescent lamp driving apparatus using a piezoelectric transformer, i.e., an inverter circuit. In the figure, a variable oscillation circuit 1, a waveform shaping circuit 2, a driving circuit 3, a resistor 4, a piezoelectric transformer 5, and a cold cathode fluorescent lamp 6 have the same functions as those in the example shown in FIG. 1. The resonance frequency of the piezoelectric transformer is varied by changes in environments such as the temperature and the load. If the piezoelectric transformer 5 is driven by a constant frequency as in the circuit shown in FIG. 5, the relationship between the resonance frequency of the piezoelectric transformer 5 and the driving frequency is varied. If the driving frequency is largely deviated from the resonance frequency of the piezoelectric transformer 5, the voltage stepup ratio of the piezoelectric transformer 5 is critically reduced. As a result, a sufficient current cannot be caused to flow through the cold cathode fluorescent lamp 6, and the cold cathode fluorescent lamp 6 cannot keep sufficient brightness.

The circuit shown in FIG. 6 can comply with the variation in the resonance frequency of the piezoelectric transformer 5 which is due to the environments. A feedback resistor 7 having a small resistance is connected in series to the cold cathode fluorescent lamp 6. The feedback resistor 7 is used for detecting the current flowing through the cold cathode fluorescent lamp 6. The voltage across the feedback resistor 7 is input to an oscillation control circuit 8. The oscillation control circuit 8 controls the frequency of the output signal of the variable oscillation circuit 1 so that the voltage across the feedback resistor 7 is constant, i.e., the current flowing through the cold cathode fluorescent lamp 6 is constant. As a result of the control, the cold cathode fluorescent lamp 6 is lit with substantially constant brightness. At this time, if the resistor 9 is not connected, the impedance of the cold cathode fluorescent lamp 6 changes, and the current flowing through the cold cathode fluorescent lamp 6 is unstably varied as shown in FIG. 2, with the result that it is impossible to control the frequency of the output signal of the variable oscillation circuit 1 so that the current flowing through the cold cathode fluorescent lamp 6 is constant. In other words, the pulsation of the value of the current flowing through the cold cathode fluorescent lamp 6 can be suppressed by the connection of the resistor 9 between the output terminal of the piezoelectric transformer 5 and the cold cathode fluorescent lamp 6. Thus, it is possible to stably control the frequency of the output signal of the variable oscillation circuit 1 so that the current flowing through the cold cathode fluorescent lamp 6 is constant.

Figure 7:
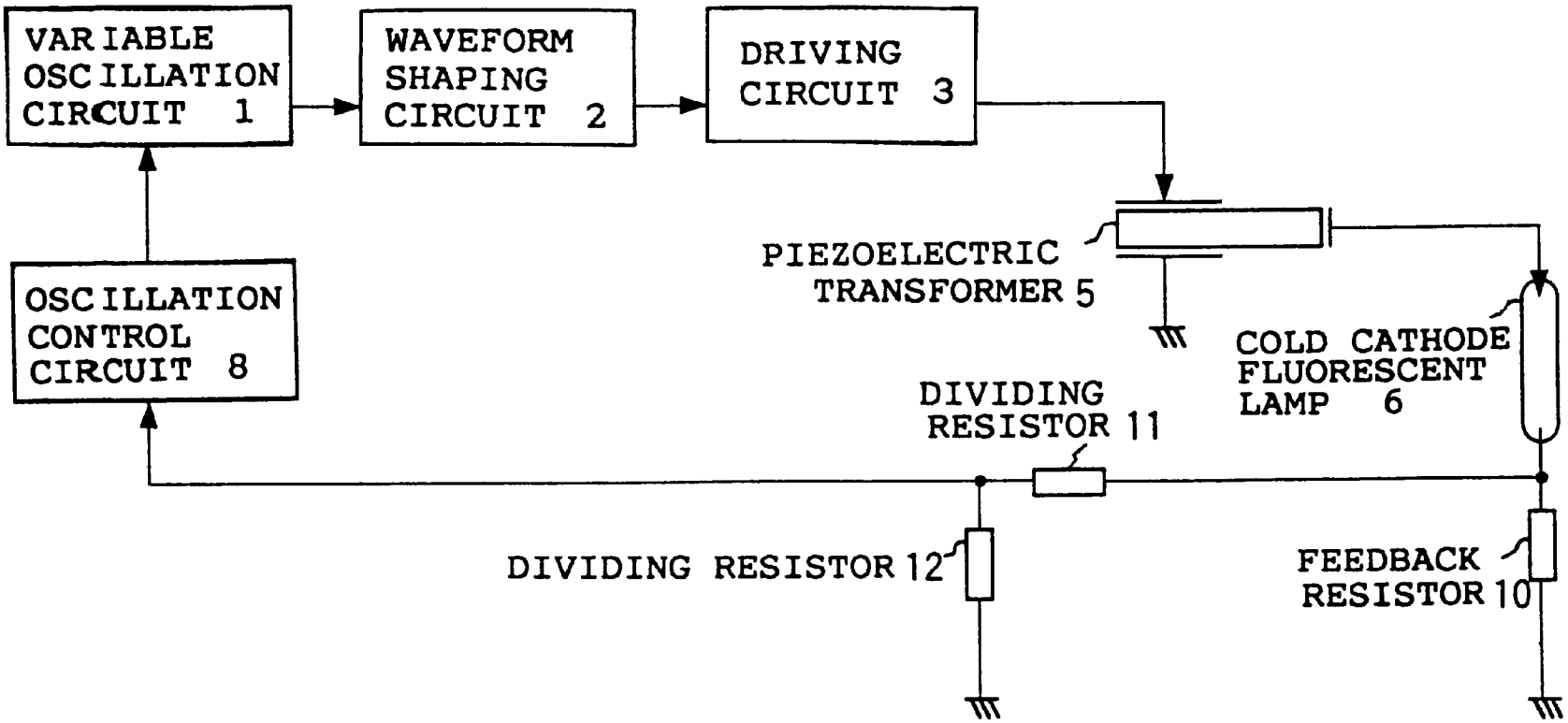
FIG. 7 is a block diagram of another example of Embodiment 2 of the cold cathode fluorescent lamp driving apparatus using a piezoelectric transformer according to the invention.

FIG. 7 is a block diagram of another example of a cold cathode fluorescent lamp driving apparatus using a piezoelectric transformer, i.e., an inverter circuit. In the figure, a variable oscillation circuit 1, a waveform shaping circuit 2, a driving circuit 3, a resistor 4, a piezoelectric transformer 5, and a cold cathode fluorescent lamp 6 have the same functions as those in the example shown in FIG. 1. The circuit shown in the figure can comply with the variation in the resonance frequency of the piezoelectric transformer 5 which is due to the environments. A feedback resistor 10 is connected in series to the cold cathode fluorescent lamp 6. The feedback resistor 10 is used for detecting the current flowing through the cold cathode fluorescent lamp 6, and suppresses the pulsation of the current flowing through the cold cathode fluorescent lamp 6. As the resistance of the feedback resistor 10 is made higher, the effect for suppressing the pulsation of the current increases, but the loss due to the resistor 10 is increased so that the efficiency of the driving circuit is decreased. Thus, the value of the resistor must be appropriately determined in consideration of the magnitude of the pulsation and the driving efficiency. For example, a range of several percent to several tens of percent of the input impedance of the cold cathode fluorescent lamp 6 in the driven state is used as a guide.

The voltage across the feedback resistor 10 is divided by dividing resistors 11 and 12, and then input to an oscillation control circuit 8. The oscillation control circuit 8 controls the frequency of the output signal of the variable oscillation circuit 1 so that the voltage across the feedback resistor 10 is constant, i.e., the current flowing through the cold cathode fluorescent lamp 6 is constant. As a result of the control, the cold cathode fluorescent lamp 6 is lit with substantially constant brightness. In other words, even if the impedance of the cold cathode fluorescent lamp 6 complicatedly changes, the feedback resistor 10 suppresses the pulsation of the current flowing through the cold cathode fluorescent lamp 6. Thus, it is possible to control the frequency of the output signal of the variable oscillation circuit 1 so that the current flowing through the cold cathode fluorescent lamp 6 is constant.

Embodiment 3

Figure 8:
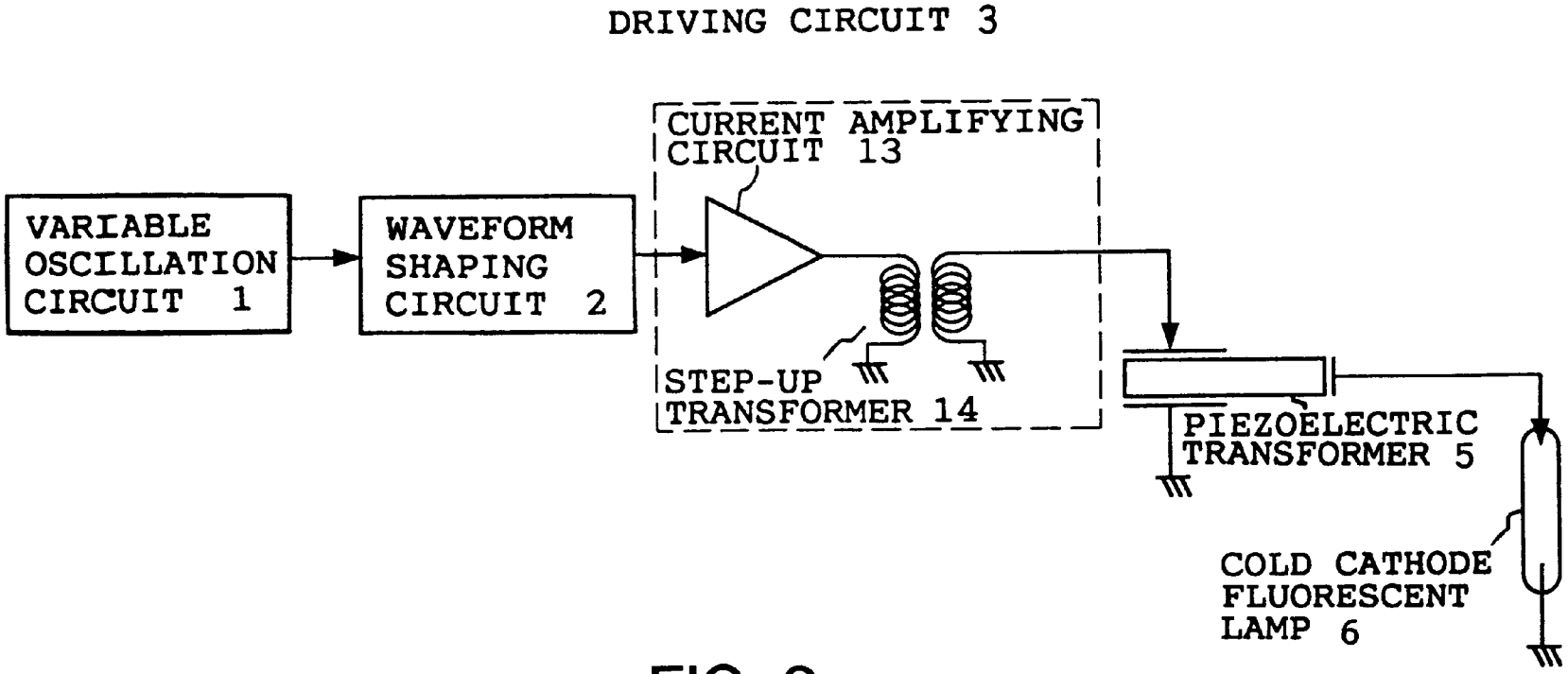
FIG. 8 is a block diagram of an example of Embodiment 3 of a cold cathode fluorescent lamp driving apparatus using a piezoelectric transformer according to the invention.

FIG. 8 is a block diagram showing a cold cathode fluorescent lamp driving apparatus using a piezoelectric transformer, i.e., an inverter circuit as an example of Embodiment 3 of the invention. In the figure, the piezoelectric transformer 5 may be a piezoelectric transformer of any desired type, i.e., a Rosen type or another type. A variable oscillation circuit 1 generates an AC driving signal of a frequency in the vicinity of the resonance frequency of the piezoelectric transformer 5. When the piezoelectric transformer 5 is driven by a driving signal having a rectangular waveform, components other than components in the vicinity of the resonance frequency are transformed into heat in the piezoelectric transformer 5. In the view point of the reliability of the piezoelectric transformer 5 and the conversion efficiency, the waveform of the output signal of the variable oscillation circuit 1 is shaped so as to be substantially sinusoidal by a waveform shaping circuit 2. In a simple case, the waveform shaping circuit 2 is a low pass filter. In the case where the efficiency is especially significant, a bandpass filter is used as the waveform shaping circuit 2. The output of the waveform shaping circuit 2 is subjected by a driving circuit 3 to current amplification or voltage amplification so as to be amplified to a level sufficient for driving the piezoelectric transformer 5. The output of the driving circuit 3 is input to the piezoelectric transformer 5. The piezoelectric transformer 5 boosts an input voltage to a high voltage by the piezoelectric effect. The output signal of the piezoelectric transformer 5 is applied to a cold cathode fluorescent lamp 6 so that the cold cathode fluorescent lamp 6 is lit.

In a cold cathode fluorescent lamp driving circuit using the piezoelectric transformer 5 such as that shown in FIG. 8, usually, the output frequency is often set to be about 50 to 200 kHz. If such a high frequency is used to drive the cold cathode fluorescent lamp 6, the cold cathode fluorescent lamp 6 exhibits complicated behavior. For example, the absolute value and the phase of the impedance are unstably varied. Even if an AC voltage having a constant amplitude is used for driving, the current flowing through the cold cathode fluorescent lamp 6 is unstably pulsated as shown in FIG. 2. In the graph of FIG. 2, the abscissa indicates the time, and the ordinate indicates an envelope of the waveform of the current flowing through the cold cathode fluorescent lamp 6. The period of the current variation is about several hundreds of Hz to several kHz. The magnitude of the variation reaches several percent to several tens of percent of the maximum current. As the driving frequency is made higher, or as the diameter of the fluorescent lamp is decreased, the unstableness tends to be increased. If the unstableness of the cold cathode fluorescent lamp 6 is increased, the piezoelectric transformer 5 cannot withstand the load fluctuation. Thus, larger operation unstableness is caused, and then the heat generation of the piezoelectric transformer 5 is increased so that the characteristics are deteriorated and the life period is shortened. The brightness of the cold cathode fluorescent lamp 6 becomes unstable, and the life period is similarly shortened.

In the driving circuit shown in FIG. 8, an electromagnetic step-up transformer 14 is connected between the driving circuit 3 and an input terminal of the piezoelectric transformer 5. The output impedance of the step-up transformer 14 is set to be high. Even if the impedance of the cold cathode fluorescent lamp 6 decreases, the piezoelectric transformer 5 cannot supply a large current. As a result, the value of the current flowing through the cold cathode fluorescent lamp 6 can be kept substantially constant as shown in FIG. 3. In the graph of FIG. 3, the abscissa indicates the time, and the ordinate indicates an envelope of the waveform of the current flowing through the cold cathode fluorescent lamp 6. Since the input current of the piezoelectric transformer is limited, the pulsation of the current flowing through the cold cathode fluorescent lamp 6 such as that shown in FIG. 2 can be suppressed. As the output impedance of the step-up transformer 14 is made higher, the effect for suppressing the pulsation of the current increases, but the loss due to the step-up transformer 14 is increases so that the efficiency of the driving circuit is decreased. Thus, the value of the resistor must be appropriately determined in consideration of the magnitude of the pulsation and the driving efficiency. For example, as a guide, the impedance of the step-up transformer 14 is adjusted by the windings or the core so as to be in the range from several percent to several tens of percent of the input impedance of the piezoelectric transformer 5.

Figure 9:
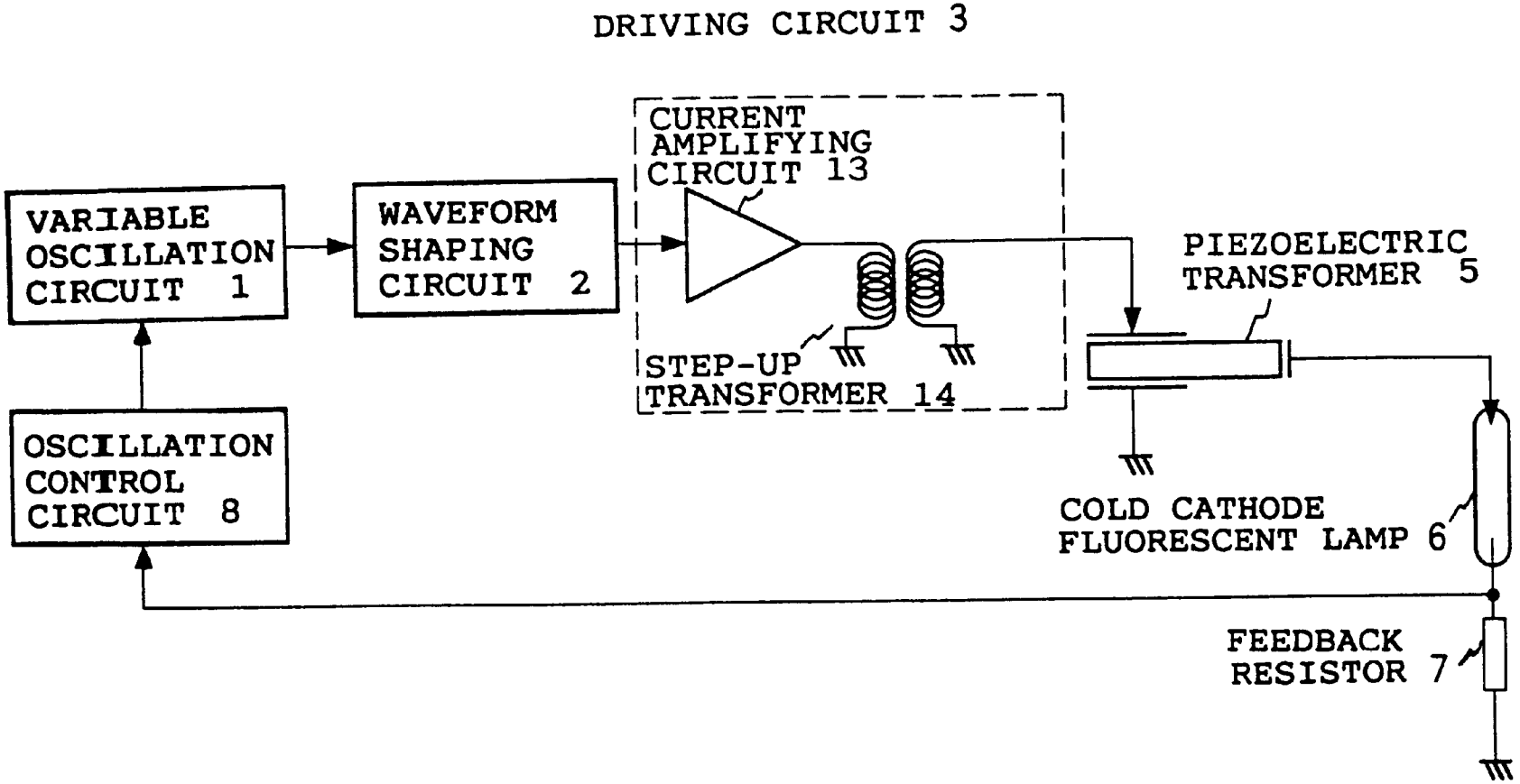
FIG. 9 is a block diagram of another example of Embodiment 3 of the cold cathode fluorescent lamp driving apparatus using a piezoelectric transformer according to the invention.

FIG. 9 is a block diagram of another example of a cold cathode fluorescent lamp driving apparatus using a piezoelectric transformer, i.e., an inverter circuit. In the figure, a variable oscillation circuit 1, a waveform shaping circuit 2, a driving circuit 3, a resistor 4, a piezoelectric transformer 5, and a cold cathode fluorescent lamp 6 have the same functions as those in the example shown in FIG. 8. The resonance frequency of the piezoelectric transformer is varied by changes in environments such as the temperature and the load. If the piezoelectric transformer 5 is driven by a constant frequency as in the circuit shown in FIG. 8, the relationship between the resonance frequency of the piezoelectric transformer 5 and the driving frequency is varied. If the driving frequency is largely deviated from the resonance frequency of the piezoelectric transformer, the voltage stepup ratio of the piezoelectric transformer is critically reduced. As a result, a sufficient current cannot be caused to flow through the cold cathode fluorescent lamp 6, and the cold cathode fluorescent lamp 6 cannot keep sufficient brightness.

The circuit shown in FIG. 9 can comply with the variation in the resonance frequency of the piezoelectric transformer 5 which is due to the environments. A feedback resistor 7 having a small resistance is connected in series to the cold cathode fluorescent lamp 6. The feedback resistor 7 is used for detecting the current flowing through the cold cathode fluorescent lamp 6. The voltage across the feedback resistor 7 is input to an oscillation control circuit 8. The oscillation control circuit 8 controls the frequency of the output signal of the variable oscillation circuit 1 so that the voltage across the feedback resistor 7 is constant, i.e., the current flowing through the cold cathode fluorescent lamp 6 is constant. As a result of the control, the cold cathode fluorescent lamp 6 is lit with substantially constant brightness. At this time, if the resistor 4 is not connected, the impedance of the cold cathode fluorescent lamp 6 changes, and the current flowing through the cold cathode fluorescent lamp 6 is unstably varied as shown in FIG. 2, with the result that it is impossible to control the frequency of the output signal of the variable oscillation circuit 1 so that the current flowing through the cold cathode fluorescent lamp 6 is constant. In other words, the pulsation of the value of the current flowing through the cold cathode fluorescent lamp 6 can be suppressed by the connection of the resistor 4 between the driving circuit 3 and the input terminal of the piezoelectric transformer 5. Thus, it is possible to control the frequency of the output signal of the variable oscillation circuit 1 so that the current flowing through the cold cathode fluorescent lamp 6 is constant.

Figure 10:
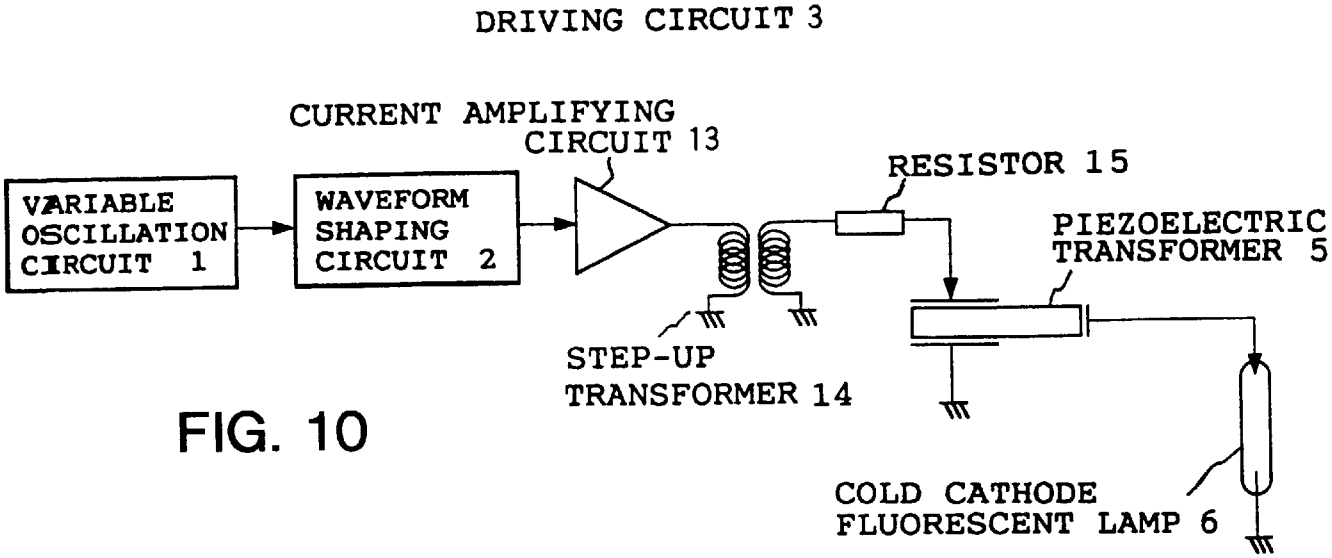
FIG. 10 is a block diagram of another example of Embodiment 3 of the cold cathode fluorescent lamp driving apparatus using a piezoelectric transformer according to the invention.

FIG. 10 is a block diagram of another example of a cold cathode fluorescent lamp driving apparatus using a piezoelectric transformer, i.e., an inverter circuit. In the figure, a variable oscillation circuit 1, a waveform shaping circuit 2, a driving circuit 3, a resistor 4, a piezoelectric transformer 5, and a cold cathode fluorescent lamp 6 have the same functions as those in the example shown in FIG. 8. In the driving circuit shown in FIG. 10, an electromagnetic step-up transformer 14 is connected between the driving circuit 3 and an input terminal of the piezoelectric transformer 5. A resistor 15 is connected to the output of the step-up transformer 14. Even if the impedance of the cold cathode fluorescent lamp 6 decreases, the piezoelectric transformer 5 cannot supply a large current. As a result, the value of the current flowing through the cold cathode fluorescent lamp 6 can be kept substantially constant as shown in FIG. 3. Since the input current of the piezoelectric transformer is limited, the pulsation of the current flowing through the cold cathode fluorescent lamp 6 such as that shown in FIG. 2 can be suppressed. As the value of the resistor 15 connected to the output of the step-up transformer 14 is increased, the effect for suppressing the pulsation of the current increases, but the loss is increased so that the efficiency of the driving circuit is decreased. Thus, the value of the resistor must be appropriately determined in consideration of the magnitude of the pulsation and the driving efficiency. For example, as a guide, the resistor 15 is adjusted so as to be in the range of several percent to several tens of percent of the input impedance of the piezoelectric transformer 5.

In the circuit shown in FIG. 10, the resistor 15 is connected to the output of the step-up transformer 14. Instead of the resistor 15, a coil may be connected. Such a configuration can attain the same effects. As the inductance of the coil connected to the output of the step-up transformer 14 is made higher, the effect for suppressing the pulsation of the current increases, but the loss is increased so that the efficiency of the driving circuit is decreased. Thus, it is necessary to determine an appropriate impedance in consideration of the magnitude of the pulsation and the driving efficiency. For example, as a guide, the impedance of the coil is adjusted so as to be in the range of several percent to several tens of percent of the input impedance of the piezoelectric transformer 5. In a case where the impedance is about 5% to 20%, for example, it is possible to satisfy the requirements for the efficiency and the stability.

The circuit shown in FIG. 10 can comply with the variation in the resonance frequency of the piezoelectric transformer 5 which is due to the environments. A feedback resistor is connected in series to the cold cathode fluorescent lamp 6. The feedback resistor is used for detecting the current flowing through the cold cathode fluorescent lamp 6. In such a construction, it is easy to control the frequency of the output signal of the variable oscillation circuit 1 so that the voltage across the feedback resistor is constant, i.e., the current flowing through the cold cathode fluorescent lamp 6 is constant.

Embodiment 4

Figure 11:
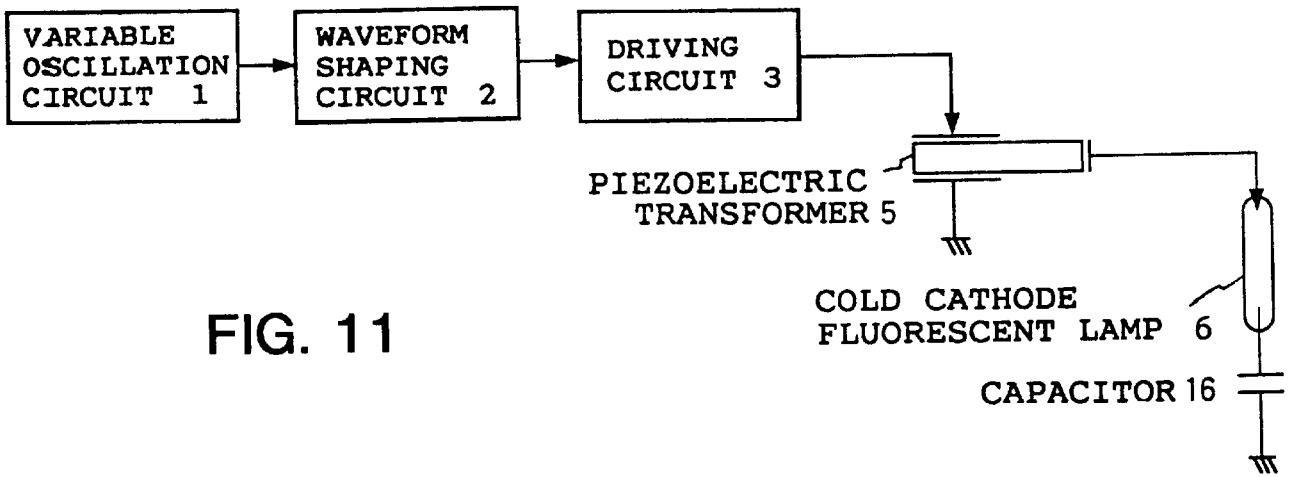
FIG. 11 is a block diagram of an example of Embodiment 4 of a cold cathode fluorescent lamp driving apparatus using a piezoelectric transformer according to the invention.

FIG. 11 is a block diagram showing a cold cathode fluorescent lamp driving apparatus using a piezoelectric transformer, i.e., an inverter circuit as an example of Embodiment 4 of the invention. In the figure, the piezoelectric transformer 5 may be a piezoelectric transformer of any desired type, i.e., a Rosen type or another type. A variable oscillation circuit 1 generates an AC driving signal of a frequency in the vicinity of the resonance frequency of the piezoelectric transformer 5. When the piezoelectric transformer 5 is driven by a driving signal having a rectangular waveform, components other than those in the vicinity of the resonance frequency are transformed into heat in the piezoelectric transformer 5. In the view point of the reliability of the piezoelectric transformer 5 and the conversion efficiency, the waveform of the output signal of the variable oscillation circuit 1 is shaped so as to be substantially sinusoidal by a waveform shaping circuit 2. In a simple case, the waveform shaping circuit 2 is a low pass filter. In the case where the efficiency is especially significant, a bandpass filter is used as the waveform shaping circuit 2. The output of the waveform shaping circuit 2 is subjected by a driving circuit 3 to voltage amplification or current amplification so as to be amplified to a level sufficient for driving the piezoelectric transformer 5. The driving circuit 3 is configured by a current amplifier 12 and a step-up transformer 13. The output of the driving circuit 3 is input to the piezoelectric transformer 5. The piezoelectric transformer 5 boosts the input voltage to a high voltage by the piezoelectric effect. The output signal of the piezoelectric transformer 5 is applied to a cold cathode fluorescent lamp 6 so that the cold cathode fluorescent lamp 6 is lit.

In a driving circuit using the piezoelectric transformer 5, usually, the output frequency is often set to be about 50 to 200 kHz. If such a high frequency is used to drive the cold cathode fluorescent lamp 6, the cold cathode fluorescent lamp 6 exhibits complicated behavior. For example, the absolute value and the phase of the impedance are unstably varied. Even if an AC voltage having a constant amplitude is used for driving, the current flowing through the cold cathode fluorescent lamp 6 is unstably pulsated as shown in FIG. 2. In the graph of FIG. 2, the abscissa indicates the time, and the ordinate indicates an envelope of the waveform of the current flowing through the cold cathode fluorescent lamp 6. The period of the current variation is about several hundreds of Hz to several kHz. The magnitude of the variation reaches several percent to several tens of percent of the maximum current. As the driving frequency is made higher, or as the diameter of the fluorescent lamp is decreased, the unstableness tends to be increased. If the unstableness of the cold cathode fluorescent lamp 6 is increased, the piezoelectric transformer 5 cannot withstand the load fluctuation. Thus, larger operation unstableness is caused, and then the heat generation of the piezoelectric transformer 5 is increased so that the characteristics are deteriorated and the life period is shortened. The brightness of the cold cathode fluorescent lamp 6 becomes unstable, and the life period is similarly shortened.

In the driving circuit shown in FIG. 11, a capacitor 16 is connected in series between the cold cathode fluorescent lamp 6 and the common level. Accordingly, both the terminals of the cold cathode fluorescent lamp 6 are connected to the output capacitance of the piezoelectric transformer 5 and the capacitance of the capacitor 16. The cold cathode fluorescent lamp 6 is driven in such a manner that loads (capacitive loads) are connected to both the terminals of the cold cathode fluorescent lamp 6 for the purpose of balance. According to the invention, it was found for the first time that, if the cold cathode fluorescent lamp 6 is driven by unbalanced loads, it operates unstably, and, if the cold cathode fluorescent lamp 6 is driven by balanced loads, such an unstable operation can be suppressed. The capacitor 16 is connected in series between the cold cathode fluorescent lamp 6 and the common level, and the cold cathode fluorescent lamp 6 is driven in such a manner that both the terminals of the cold cathode fluorescent lamp 6 are connected to balanced loads (capacitive loads), thereby suppressing the pulsation of the current flowing through the cold cathode fluorescent lamp 6 such as that shown in FIG. 2. As a result, the value of the current flowing through the cold cathode fluorescent lamp 6 can be made substantially constant as shown in FIG. 3. In the graph of FIG. 3, the abscissa indicates the time, and the ordinate indicates an envelope of the waveform of the current flowing through the cold cathode fluorescent lamp 6. The effects could be ascertained when the capacitance of the capacitor 16 is about 0.2 to 2 times as large as the output capacitance of the piezoelectric transformer 16.

Figure 12:
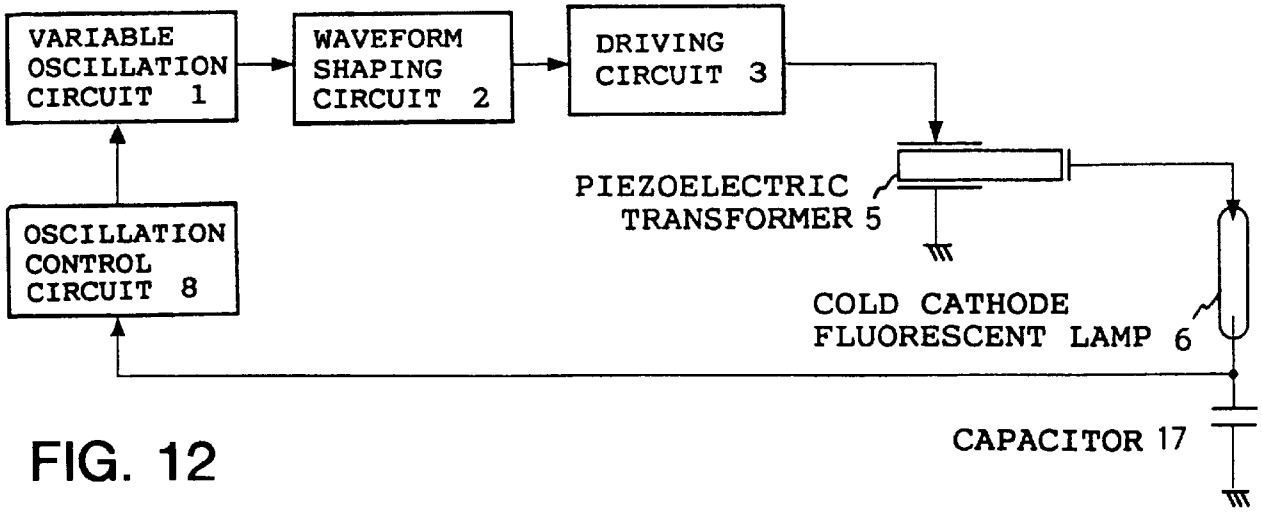
FIG. 12 is a block diagram of another example of Embodiment 4 of the cold cathode fluorescent lamp driving apparatus using a piezoelectric transformer according to the invention.

FIG. 12 is a block diagram of another example of a cold cathode fluorescent lamp driving apparatus using a piezoelectric transformer, i.e., an inverter circuit. In the figure, a variable oscillation circuit 1, a waveform shaping circuit 2, a driving circuit 3, a resistor 4, a piezoelectric transformer 5, and a cold cathode fluorescent lamp 6 have the same functions as those in the example shown in FIG. 1. The circuit shown in the figure can comply with the variation in the resonance frequency of the piezoelectric transformer 5 which is due to the environments. A capacitor 17 is connected in series to the cold cathode fluorescent lamp 6. The capacitor 17 is used for detecting the current flowing through the cold cathode fluorescent lamp 6, and suppresses the pulsation of the current flowing through the cold cathode fluorescent lamp 6.

The voltage across the capacitor 17 is input to an oscillation control circuit 8. The oscillation control circuit 8 controls the frequency of the output signal of the variable oscillation circuit 1 so that the voltage across the capacitor 17 is constant, i.e., the current flowing through the cold cathode fluorescent lamp 6 is constant. As a result of the control, the cold cathode fluorescent lamp 6 is lit with substantially constant brightness.

Embodiment 5

Figure 13:
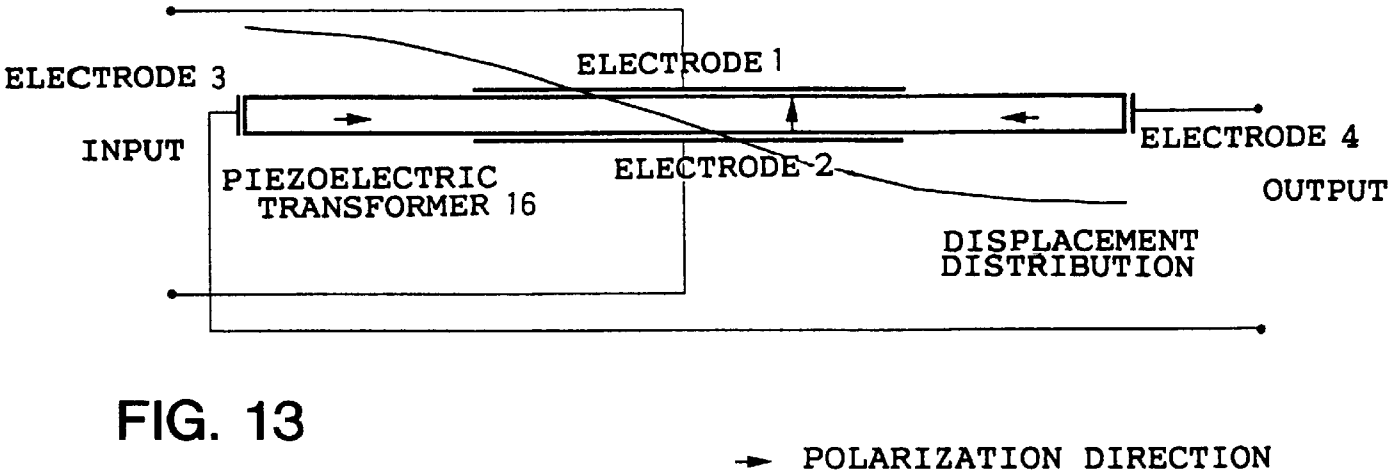
FIG. 13 is a diagram showing the configuration of a piezoelectric transformer used in an example of Embodiment 5 of a cold cathode fluorescent lamp driving apparatus using a piezoelectric transformer according to the invention.

FIG. 13 is a diagram showing the configuration of a piezoelectric transformer as an example of Embodiment 5 of the invention, as viewed from the side of the transformer. The piezoelectric transformer 18 is constructed in such a manner that electrodes on the primary side (the input side, electrodes 1 and 2) and electrodes on the secondary side (the output side, electrodes 3 and 4) are disposed on a rectangular plate made of a piezoelectric ceramic material such as lead zirconate titanate (PZT). The arrows in the figure indicate polarization directions. The primary side is polarized in the thickness direction of the rectangular plate, and the secondary side is polarized in the longitudinal direction. The electrode 2 of the primary side is connected to the common level, and an AC voltage of a frequency in the vicinity of the resonance frequency of the piezoelectric transformer 16 is applied to the electrode 2. The piezoelectric transformer 18 mechanically oscillates in the longitudinal direction (1/2-wavelength mode). The mechanical oscillation has a distribution indicated by a displacement distribution curve in FIG. 13. The mechanical oscillation is transformed into a voltage by the piezoelectric effect so as to be taken out as a high voltage from the electrodes 3 and 4 or the secondary electrodes. Unlike unbalanced outputs of a prior art piezoelectric transformer, the outputs of the piezoelectric transformer 20 are taken out from the electrodes 3 and 4 as outputs having opposite signs (balanced outputs).

Figure 14:
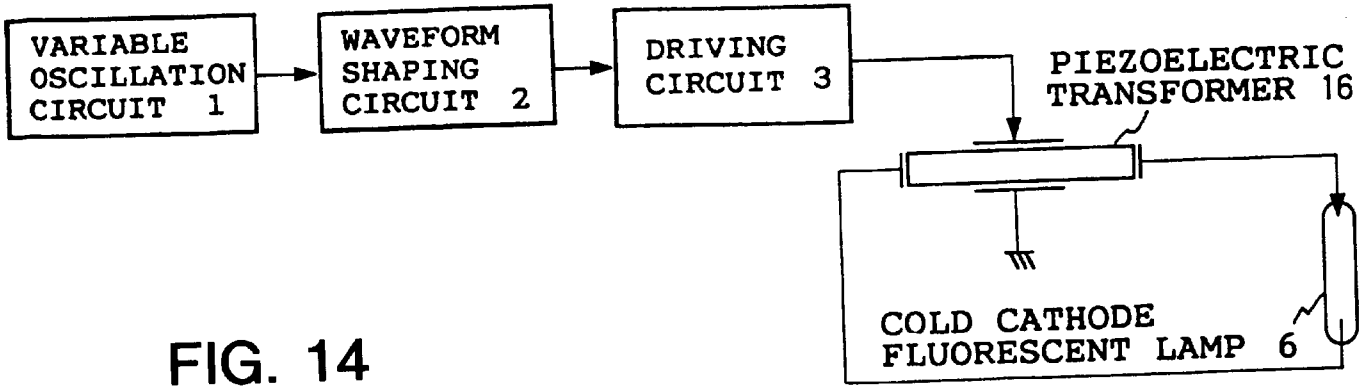
FIG. 14 is a block diagram showing an example of Embodiment 5 of the cold cathode fluorescent lamp driving apparatus using a piezoelectric transformer according to the invention.

FIG. 14 is a block diagram of a cold cathode fluorescent lamp driving apparatus using the piezoelectric transformer 18, i.e., an inverter circuit. In the figure, the piezoelectric transformer 18 is the same as that shown in FIG. 11. A variable oscillation circuit 1 generates an AC driving signal of a frequency in the vicinity of the resonance frequency in the 1/2-wavelength mode of the piezoelectric transformer 18. When the piezoelectric transformer 18 is driven by a driving signal having a rectangular waveform, components other than those in the vicinity of the resonance frequency are transformed into heat in the piezoelectric transformer 18. In the view point of the reliability of the piezoelectric transformer 18 and the conversion efficiency, the waveform of the output signal of the variable oscillation circuit 1 is shaped so as to be substantially sinusoidal by a waveform shaping circuit 2.

In a simple case, the waveform shaping circuit 2 is a low pass filter. In the case where the efficiency is especially significant, a bandpass filter is used as the waveform shaping circuit 2. The output of the waveform shaping circuit 2 is subjected by a driving circuit 3 to current amplification or voltage amplification so as to be amplified to a level sufficient for driving the piezoelectric transformer 18. The output of the driving circuit 3 is input to the electrodes 1 and 2 of the piezoelectric transformer 18. The piezoelectric transformer 18 boosts an input voltage to a high voltage by the piezoelectric effect. The output signal of the piezoelectric transformer 18 is taken out from the electrodes 3 and 4 as balanced signals which are in turn applied to a cold cathode fluorescent lamp 6 so that the cold cathode fluorescent lamp 6 is lit.

In a driving circuit using a piezoelectric transformer such as that shown in FIG. 13, usually, the output frequency is often set to be about 50 to 200 kHz. If the cold cathode fluorescent lamp 6 is driven by a prior art piezoelectric transformer having unbalanced outputs and by a high frequency, the cold cathode fluorescent lamp 6 exhibits especially complicated behavior. For example, the absolute value and the phase of the impedance are unstably varied. Even if an AC voltage having a constant amplitude is used for driving, the current flowing through the cold cathode fluorescent lamp 6 is unstably pulsated as shown in FIG. 2. In the graph of FIG. 2, the abscissa indicates the time, and the ordinate indicates an envelope of the waveform of the current flowing through the cold cathode fluorescent lamp 6. The period of the current variation is about several hundreds of Hz to several kHz. The magnitude of the variation reaches several percent to several tens of percent of the maximum current. As the driving frequency is made higher, or as the diameter of the fluorescent lamp is decreased, the unstableness tends to be increased. If the unstableness of the cold cathode fluorescent lamp 6 is increased, the piezoelectric transformer having unbalanced outputs cannot withstand the load fluctuation. Thus, larger operation unstableness is caused, and then the heat generation of the piezoelectric transformer having unbalanced outputs is increased, so that the characteristics are deteriorated and the life period is shortened. The brightness of the cold cathode fluorescent lamp 6 becomes unstable, and the life period is similarly shortened.

In the driving circuit shown in FIG. 14 using the piezoelectric transformer shown in FIG. 13, the cold cathode fluorescent lamp 6 is driven by balanced outputs of the piezoelectric transformer 16. According to the invention, it was found for the first time that, if the cold cathode fluorescent lamp 6 is driven by unbalanced outputs, it operates unstably, and, if the cold cathode fluorescent lamp 6 is driven by balanced outputs, the unstable operation thereof can be suppressed. By using a piezoelectric transformer having balanced outputs, the pulsation of the current flowing through the cold cathode fluorescent lamp 6 such as that shown in FIG. 2 can be suppressed. If the balanced outputs are used for driving, the value of the current flowing through the cold cathode fluorescent lamp 6 can be eventually substantially constant as shown in FIG. 3. In the graph of FIG. 3, the abscissa indicates the time, and the ordinate indicates an envelope of the waveform of the current flowing through the cold cathode fluorescent lamp 6.

Figure 15:
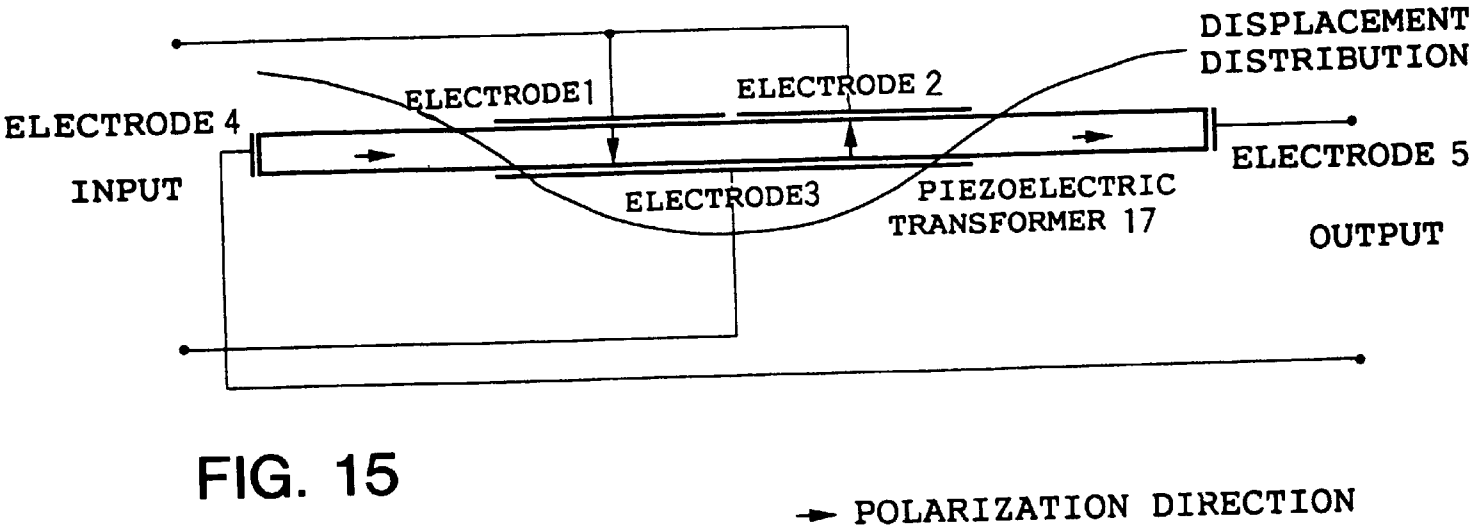
FIG. 15 is a diagram showing the configuration of another piezoelectric transformer used in the example of Embodiment 5 of the cold cathode fluorescent lamp driving apparatus using a piezoelectric transformer according to the invention.

FIG. 15 is a diagram showing the configuration of a piezoelectric transformer as an example of Embodiment 5 of the invention, as viewed from the side of the transformer. The piezoelectric transformer 19 is constructed in such a manner that electrodes on the primary side (the input side, electrodes 1, 2, and 3) and electrodes on the secondary side (the output side, electrodes 4 and 5) are disposed on a rectangular plate made of a piezoelectric ceramic material such as lead zirconate titanate (PZT). The arrows in the figure indicate polarization directions. The primary side is polarized in the thickness direction of the rectangular plate, and the secondary side is polarized in the longitudinal direction. The electrode 3 of the primary side is connected to the common level, and an AC voltage of a frequency in the vicinity of the resonance frequency of the piezoelectric transformer 19 is applied to the electrodes 1 and 2. The piezoelectric transformer 19 mechanically oscillates in the longitudinal direction (1-wavelength mode). The mechanical oscillation has a distribution indicated by a displacement distribution curve in FIG. 15. The mechanical oscillation is transformed into a voltage by the piezoelectric effect so as to be taken out as a high voltage from the electrodes 4 and 5 or the secondary electrodes. Unlike unbalanced outputs of a prior art piezoelectric transformer, the outputs of the piezoelectric transformer 19 are taken out from the electrodes 4 and 5 as outputs having opposite signs (balanced outputs).

Figure 16:
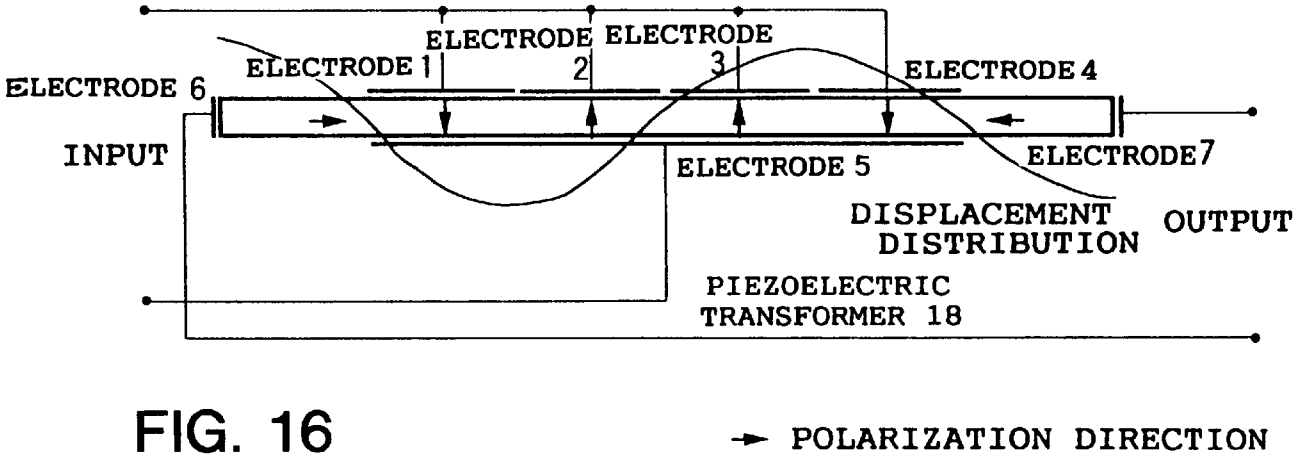
FIG. 16 is a diagram showing the configuration of another piezoelectric transformer used in the example of Embodiment 5 of the cold cathode fluorescent lamp driving apparatus using a piezoelectric transformer according to the invention.

FIG. 16 is a diagram showing the configuration of a piezoelectric transformer as another example of Embodiment 5 of the invention, as viewed from the side of the transformer. The piezoelectric transformer 20 is constructed in such a manner that electrodes on the primary side (the input side, electrodes 1, 2, 3, 4, and 5) and electrodes on the secondary side (the output side, electrodes 6 and 7) are disposed on a rectangular plate made of a piezoelectric ceramic material such as lead zirconate titanate (PZT). The arrows in the figure indicate polarization directions. The primary side is polarized in the thickness direction of the rectangular plate, and the secondary side is polarized in the longitudinal direction. The electrode 5 of the primary side is connected to the common level, and an AC voltage of a frequency in the vicinity of the resonance frequency of the piezoelectric transformer 20 is applied to the electrodes 1, 2, 3, and 4. The piezoelectric transformer 20 mechanically oscillates ill the longitudinal direction (3/2-wavelength mode). The mechanical oscillation has a distribution indicated by a displacement distribution curve in FIG. 16. The mechanical oscillation is transformed into a voltage by the piezoelectric effect so as to be taken out as a high voltage from the electrodes 6 and 7 or the secondary electrodes. Unlike unbalanced outputs of a prior art piezoelectric transformer, the outputs of the piezoelectric transformer 20 are taken out from the electrodes 6 and 7 as outputs having opposite signs (balanced outputs).

Figure 17:
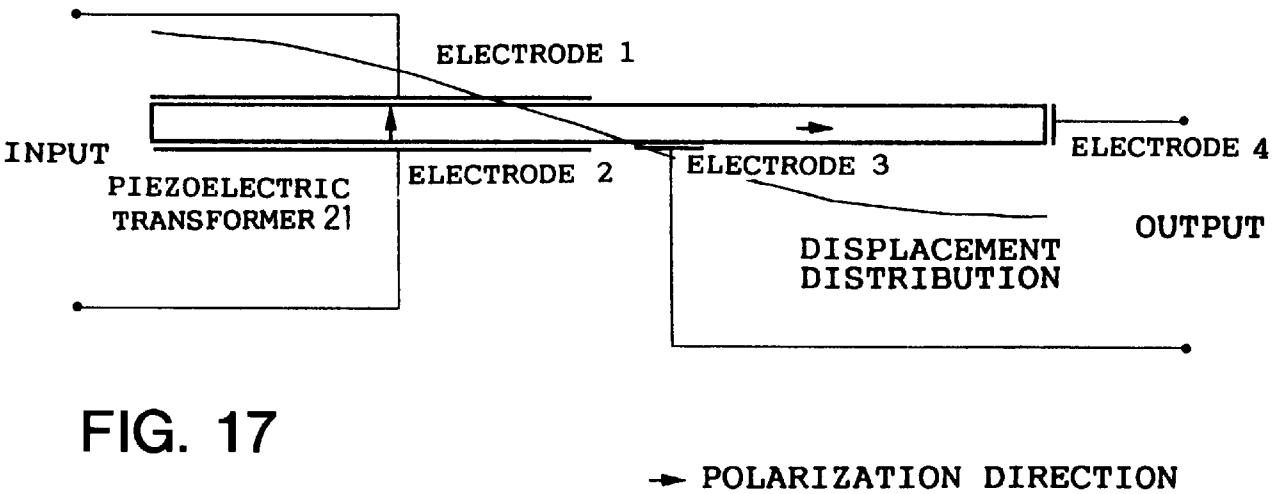
FIG. 17 is a diagram showing the configuration of a piezoelectric transformer used in the example of Embodiment 5 of the cold cathode fluorescent lamp driving apparatus using a piezoelectric transformer according to the invention.

FIG. 17 is a diagram showing the configuration of a piezoelectric transformer as another example of Embodiment 5 of the invention, as viewed from the side of the transformer. The piezoelectric transformer 21 is constructed in such a manner that electrodes on the primary side (the input side, electrodes 1 and 2) and electrodes on the secondary side (the output side, electrodes 3 and 4) are disposed on a rectangular plate made of a piezoelectric ceramic material such as lead zirconate titanate (PZT). The arrows in the figure indicate polarization directions. The primary side is polarized in the thickness direction of the rectangular plate, and the secondary side is polarized in the longitudinal direction. The electrode 2 of the primary side is connected to the common level, and an AC voltage of a frequency in the vicinity of the resonance frequency of the piezoelectric transformer 16 is applied to the electrode 1. The piezoelectric transformer 21 mechanically oscillates in the longitudinal direction (1/2-wavelength mode). The mechanical oscillation has a distribution indicated by a displacement distribution curve in FIG. 17. The mechanical oscillation is transformed into a voltage by the piezoelectric effect so as to be taken out as a high voltage from the electrodes 3 and 4 or the secondary electrodes. Unlike unbalanced outputs of a prior art piezoelectric transformer, the outputs of the piezoelectric transformer 21 are taken out from the electrodes 3 and 4 as outputs having opposite signs (balanced outputs).

A block diagram shows a cold cathode fluorescent lamp driving apparatus using the piezoelectric transformer 21, i.e., an inverter circuit. It is the same as that shown in FIG. 14, and hence the description thereof is omitted. In the driving circuit using the piezoelectric transformer shown in FIG. 17, the cold cathode fluorescent lamp is driven by balanced outputs of the piezoelectric transformer 21. According to the invention, it was found for the first time that, if the cold cathode fluorescent lamp is driven by unbalanced outputs, it operates unstably, and, if the cold cathode fluorescent lamp is driven by balanced outputs, the unstable operation thereof can be suppressed. By using a piezoelectric transformer having balanced outputs, the pulsation of the current flowing through the cold cathode fluorescent lamp 6 such as that shown in FIG. 2 can be suppressed. If the balanced outputs are used for driving, the value of the current flowing through the cold cathode fluorescent lamp 6 can be eventually substantially constant as shown in FIG. 3. In the graph of FIG. 3, the abscissa indicates the time, and the ordinate indicates an envelope of the waveform of the current flowing through the cold cathode fluorescent lamp.

Figure 18:
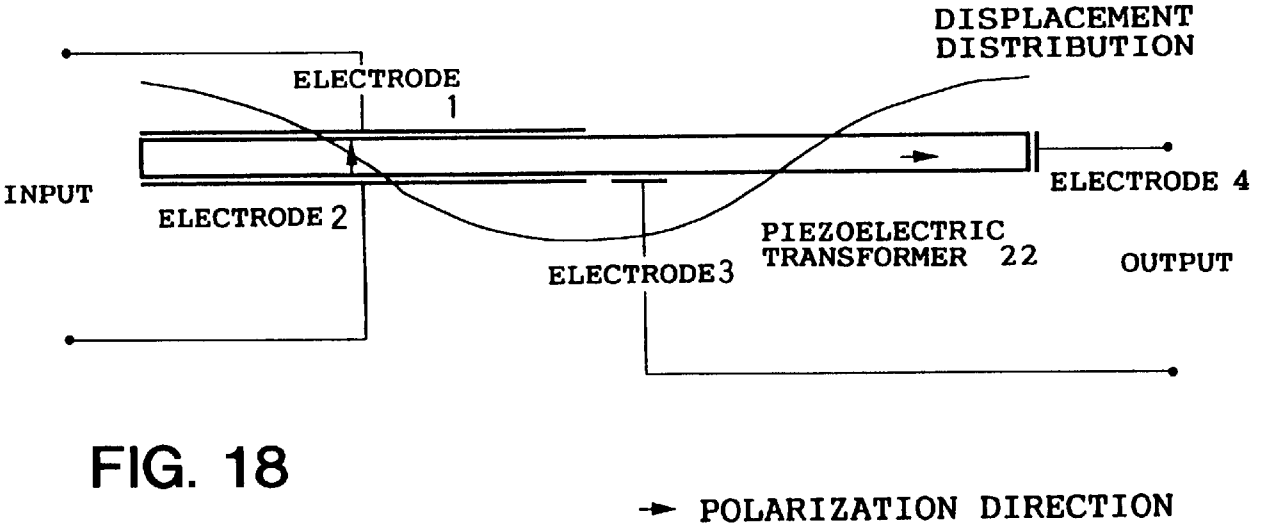
FIG. 18 is a diagram showing the configuration of another piezoelectric transformer used in the example of Embodiment 5 of the cold cathode fluorescent lamp driving apparatus using a piezoelectric transformer according to the invention.

FIG. 18 is a diagram showing the configuration of a piezoelectric transformer as another example of Embodiment 5 of the invention, as viewed from the side of the transformer. The piezoelectric transformer 22 is constructed in such a manner that electrodes on the primary side (the input side, electrodes 1 and 2) and electrodes on the secondary side (the output side, electrodes 3 and 4) are disposed on a rectangular plate made of a piezoelectric ceramic material such as lead zirconate titanate (PZT). The arrows in the figure indicate polarization directions. The primary side is polarized in the thickness direction of the rectangular plate, and the secondary side is polarized in the longitudinal direction. The electrode 2 of the primary side is connected to the common level, and an AC voltage of a frequency in the vicinity of the resonance frequency of the piezoelectric transformer 22 is applied to the electrode 1. The piezoelectric transformer 22 mechanically oscillates in the longitudinal direction (1-wavelength mode). The mechanical oscillation has a distribution indicated by a displacement distribution curve in FIG. 18. The mechanical oscillation is transformed into a voltage by the piezoelectric effect so as to be taken out as a high voltage from the electrodes 3 and 4 or the secondary electrodes. Unlike unbalanced outputs of a prior art piezoelectric transformer, the outputs of the piezoelectric transformer 22 are taken out from the electrodes 3 and 4 as outputs having opposite signs (balanced outputs).

Figure 19:
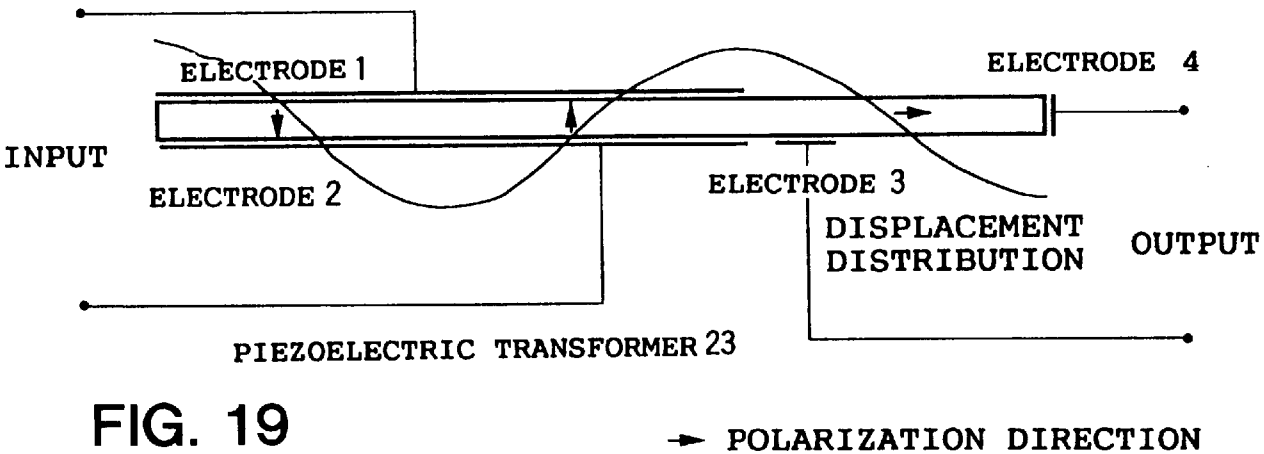
FIG. 19 is a diagram showing the configuration of another piezoelectric transformer used in the example of Embodiment 5 of the cold cathode fluorescent lamp driving us using a piezoelectric transformer according to the invention.
Figure 20:
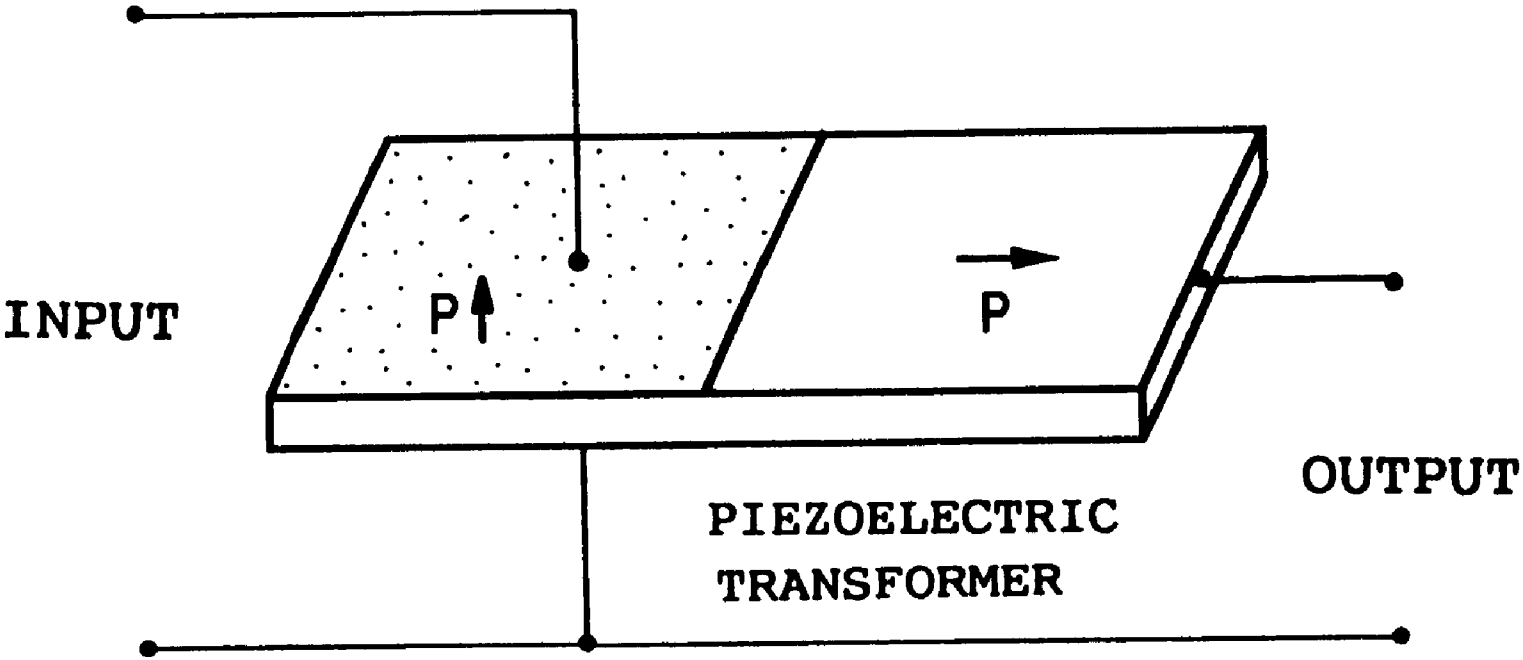
FIG. 20 PRIOR ART
FIG. 20 is a diagram showing the configuration of a conventional Rosen-type piezoelectric transformer.
Figure 21:
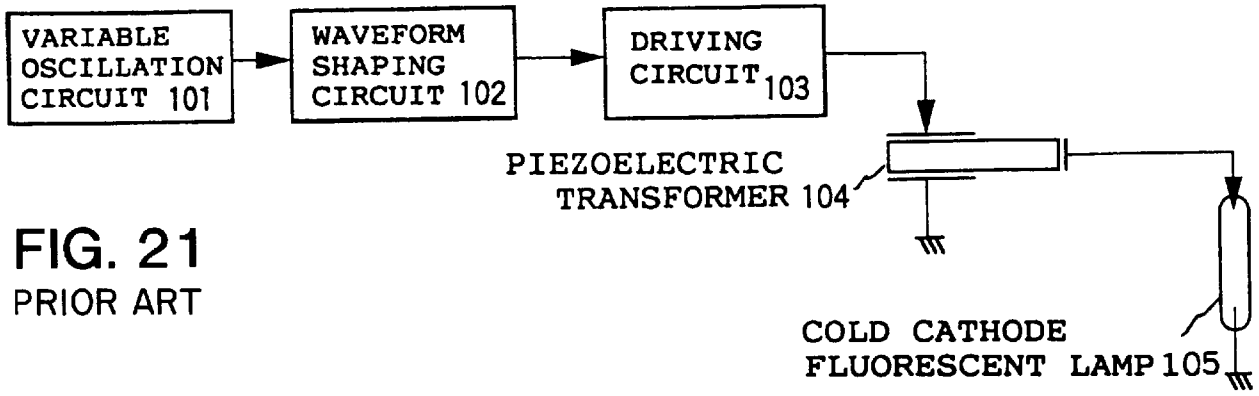
FIG. 21 PRIOR ART
FIG. 21 is a block diagram showing a prior art cold cathode fluorescent lamp driving apparatus using a piezoelectric transformer.
Figure 22:
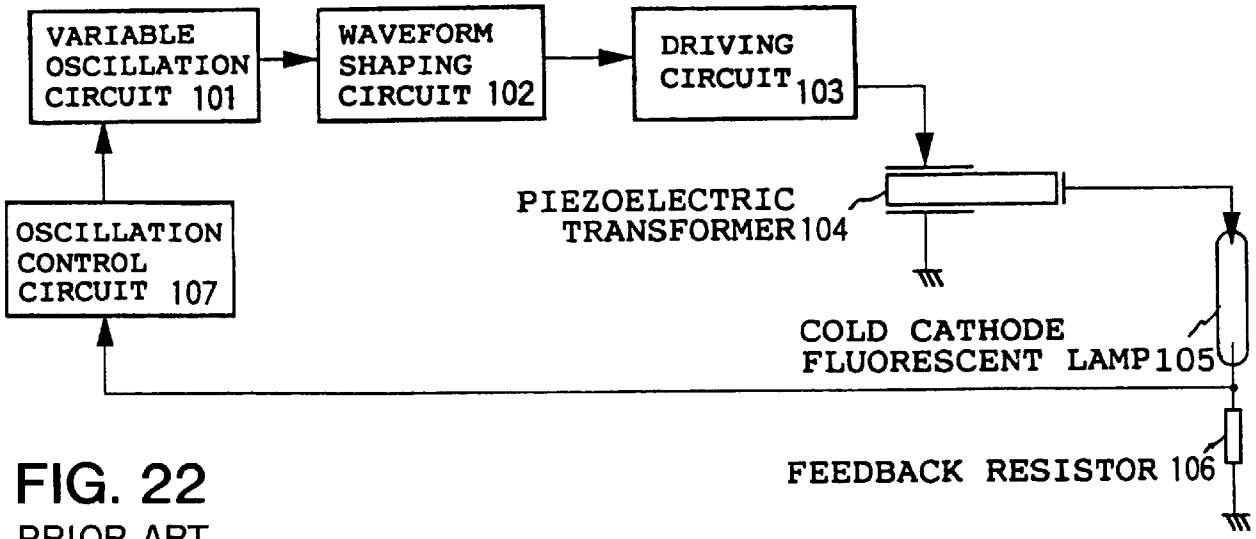
FIG. 22 PRIOR ART
FIG. 22 is a block diagram showing another prior art of another conventional cold cathode fluorescent lamp driving apparatus using a piezoelectric transformer.

FIG. 19 is a diagram showing the configuration of a piezoelectric transformer as another example of Embodiment 5 of the invention, as viewed from the side of the transformer. The piezoelectric transformer 23 is constructed in such a manner that electrodes on the primary side (the input side, electrodes 1 and 2) and electrodes on the secondary side (the output side, electrodes 3 and 4) are disposed on a rectangular plate made of a piezoelectric ceramic material such as lead zirconate titanate (PZT). The arrows in the figure indicate polarization directions. The primary side is polarized in the thickness direction of the rectangular plate, and the secondary side is polarized in the longitudinal direction. The electrode 2 of the primary side is connected to the common level, and an AC voltage of a frequency in the vicinity of the resonance frequency of the piezoelectric transformer 23 is applied to the electrode 1. The piezoelectric transformer 23 mechanically oscillates in the longitudinal direction (3/2-wavelength mode). The mechanical oscillation has a distribution indicated by a displacement distribution curve in FIG. 19. The mechanical oscillation is transformed into a voltage by the piezoelectric effect, and a high voltage can be taken out from the electrodes 3 and 4 or the secondary electrodes. Unlike unbalanced outputs of a prior art piezoelectric transformer, the outputs of the piezoelectric transformer 22 are taken out from the electrodes 3 and 4 as outputs having opposite signs (balanced outputs).

In the examples shown in FIGS. 17, 18, and 19, the output electrode 3 is disposed on the lower face of the piezoelectric transformer. Alternatively, the output electrode may be disposed on the upper face of the piezoelectric transformer. In such a case, the same effects can also be attained. Alternatively, the output electrode 3 may be disposed so as to be wound once around the piezoelectric transformer. Also in such a case, the same effects can be attained.

It is noted that one skilled in the art would appreciate that a cold cathode fluorescent lamp driving apparatus using a piezoelectric transformer, as set forth in the above embodiments, could be used in a backlight of a liquid crystal display device.

What is claimed is:

1. A cold cathode fluorescent lamp driving apparatus using a piezoelectric transformer, comprising: an oscillation circuit which generates an alternating-current driving signal; a driving circuit which amplifies said alternating-current driving signal; a piezoelectric transformer in which an input electrode and an output electrode are disposed on a piezoelectric element; and a cold cathode fluorescent lamp, wherein a resistor having a value sufficient to suppress fluctuation of said alternating-current driving signal is connected in series between an output of said amplifying circuit and said input electrode of said piezoelectric transformer.

2. A cold cathode fluorescent lamp driving apparatus using a piezoelectric transformer according to claim 1, wherein the resistor has a value of about 5% to 20% of an input impedance of said piezoelectric transformer.

3. A cold cathode fluorescent lamp driving apparatus using a piezoelectric transformer, comprising: an oscillation circuit which generates an alternating-current driving signal; a driving circuit which amplifies said alternating-current driving signal; a piezoelectric transformer which an input electrode and an output electrode are disposed on a piezoelectric element; and a cold cathode fluorescent lamp, wherein said driving circuit comprises a current amplifying circuit and a step-up transformer, and a resistor or an inductance is connected in series between an output terminal of said step-up transformer and the input electrode, said resistor or said inductance having an impedance of about 5% to 20% of an input impedance of said piezoelectric transformer to suppress fluctuation of said alternating-current driving signal said capacitor having a capacitance value that is balanced to an output capacitance value of said piezoelectric transformer.

4. A cold cathode fluorescent lamp driving apparatus using a piezoelectric transformer, comprising: an oscillation circuit which generates an alternating-current driving signal; a driving circuit which amplifies said alternating-current driving signal; a piezoelectric transformer in which an two input electrode and an two output electrode are disposed on a piezoelectric element; and a cold cathode fluorescent lamp, wherein a capacitor is connected in series to a ground side of said cold cathode fluorescent lamp, said capacitor having a capacitance value that is balanced to an output capacitance value of said piezoelectric transformer.

5. A cold cathode fluorescent lamp driving apparatus using a piezoelectric transformer according to claim 4, wherein the capacitor has a value which is about 0.2 to 2 times as large as an output capacitance of said piezoelectric transformer.

6. A cold cathode fluorescent lamp driving apparatus using a piezoelectric transformer, comprising: an oscillation circuit which generates an alternating-current driving signal; a driving circuit which amplifies said alternating-current driving signal; a piezoelectric transformer in which two input electrodes and two output electrodes are disposed on a rectangular plate of a piezoelectric element; and a cold cathode fluorescent lamp, wherein (a) said input electrodes are polarized in a thickness direction of said rectangular plate and said output electrodes are polarized in a longitudinal direction of said rectangular plate; and (b) said output electrodes are connected to said cold cathode fluorescent lamp providing balanced outputs.

7. A cold cathode fluorescent lamp driving apparatus using a piezoelectric transformer according to claim 6, wherein balanced outputs are taken out from both ends by longitudinally oscillating said piezoelectric transformer, and said cold cathode fluorescent lamp is connected to said balanced outputs.

8. A cold cathode fluorescent lamp driving apparatus using a piezoelectric transformer according to claim 6, wherein balanced outputs are taken out from one end by longitudinally oscillating said piezoelectric transformer, and said cold cathode fluorescent lamp is connected to said balanced outputs.

9. A cold cathode fluorescent lamp driving apparatus using a piezoelectric transformer according to claim 1, wherein said cold cathode fluorescent lamp driving apparatus is used in a liquid crystal display device to provide backlight.

10. A cold cathode fluorescent lamp driving apparatus using a piezoelectric transformer according to claim 2, wherein said cold cathode fluorescent lamp driving apparatus is used in a liquid crystal display device to provide backlight.

11. A cold cathode fluorescent lamp driving apparatus using a piezoelectric transformer according to claim 2, wherein said cold cathode fluorescent lamp driving apparatus is used in a liquid crystal display device to provide backlight.

12. A cold cathode fluorescent lamp driving apparatus using a piezoelectric transformer according to claim 3, wherein said cold cathode fluorescent lamp driving apparatus is used in a liquid crystal display device to provide backlight.

13. A cold cathode fluorescent lamp driving apparatus using a piezoelectric transformer according to claim 4, wherein said cold cathode fluorescent lamp driving apparatus is used in a liquid crystal display device to provide backlights.

14. A cold cathode fluorescent lamp driving apparatus using a piezoelectric transformer according to claim 5, wherein said cold cathode fluorescent lamp driving apparatus is used in a liquid crystal display device to provide backlight.

15. A cold cathode fluorescent lamp driving apparatus using a piezoelectric transformer according to claim 6, wherein said cold cathode fluorescent lamp driving apparatus is used in a liquid crystal display device to provide backlight.

16. A cold cathode fluorescent lamp driving apparatus using a piezoelectric transformer, comprising:

an oscillation circuit which generates an alternating-current driving signal;

a driving circuit which amplifies said alternating-current driving signal;

a piezoelectric transformer in which an input electrode and an output electrode are disposed on a piezoelectric element;

a cold cathode fluorescent lamp, and a pulsation suppression means for suppressing pulsation in the driving signal free of feedback.

17. A cold cathode fluorescent lamp driving apparatus using a piezoelectric transformer, comprising an oscillation circuit which generates an alternating-current driving signal;

a driving circuit which amplifies said alternating-current driving signal;

a piezoelectric transformer in which an input electrode, an output electrode and a grounded electrode are disposed on a piezoelectric element; said input electrode coupled to said driving circuit for receiving said alternating-current driving signal;

a cold cathode fluorescent lamp connected in series between said output electrode and said grounded electrode; and means for pulsation suppression free of feedback placed between said driving circuit and said grounded electrode.

18. A cold cathode fluorescent lamp driving apparatus using a piezoelectric transformer, comprising an oscillation circuit which generates an alternating-current driving signal;

a driving circuit which amplifies said alternating-current driving signal;

a piezoelectric transformer in which an input electrode, an output electrode and a grounded electrode are disposed on a piezoelectric element; said input electrode coupled to said driving circuit for receiving said alternating-current driving signal;

a cold cathode fluorescent lamp connected in series between said output electrode and said grounded electrode; and means for pulsation suppression being a resistor placed in series between said driving circuit and said input electrode.

19. A cold cathode fluorescent lamp driving apparatus using a piezoelectric transformer, comprising an oscillation circuit which generates an alternating-current driving signal;

a driving circuit which amplifies said alternating-current driving signal;

a piezoelectric transformer in which an input electrode, an output electrode and a grounded electrode are disposed on a piezoelectric element; said input electrode coupled to said driving circuit for receiving said alternating-current driving signal;

a cold cathode fluorescent lamp connected in series between said output electrode and said grounded electrode; and means for pulsation suppression being a resistor placed in series between said output electrode and said fluorescent lamp.

20. The cold cathode fluorescent lamp driving apparatus according to claim 17 wherein said means for pulsation suppression is a capacitor placed in series between said fluorescent lamp and said grounded electrode.

* * * * *

UNITED STATES PATENT AND TRADE MARK OFFICE

CERTIFICATE OF CORRECTION

PATENT NO. : 6,028,398
DATED : February 22, 2000
INVENTOR(S) : Kawasaki et al.

It is certified that error appears in the above-identified patent and that said Letters Patent is hereby corrected as shown below:

Column 21, line 23, delete "two".

Column 22, line 24, "backlights" should read --backlight--.

Signed and Sealed this

Twenty-seventh Day of March, 2001

Nicholas P. Godici

*Attest:*

NICHOLAS P. GODICI

*Acting Director of the United States Patent and Trademark Office*

*Attesting Officer*